US010570901B2

(12) United States Patent
Stover et al.

(10) Patent No.: US 10,570,901 B2
(45) Date of Patent: Feb. 25, 2020

(54) COMPRESSOR HAVING SOUND ISOLATION FEATURE

(71) Applicant: Emerson Climate Technologies, Inc., Sidney, OH (US)

(72) Inventors: Robert C. Stover, Versailles, OH (US); Kevin J. Gehret, Fort Loramie, OH (US); Stephen M. Seibel, Celina, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 193 days.

(21) Appl. No.: 15/633,537

(22) Filed: Jun. 26, 2017

(65) Prior Publication Data

US 2017/0292519 A1 Oct. 12, 2017

Related U.S. Application Data

(62) Division of application No. 14/553,502, filed on Nov. 25, 2014, now Pat. No. 9,689,391.

(Continued)

(51) Int. Cl.
*F03C 2/00* (2006.01)
*F03C 4/00* (2006.01)

(Continued)

(52) U.S. Cl.
CPC ..... *F04C 29/068* (2013.01); *F01C 1/0215* (2013.01); *F04C 15/0023* (2013.01);

(Continued)

(58) Field of Classification Search
CPC ..... F04C 15/0023; F04C 2230/91; F04C 2230/603; F04C 2240/805; F04C 18/0215;

(Continued)

(56) References Cited

U.S. PATENT DOCUMENTS 3,994,636 A 11/1976 McCullough et al.
5,102,316 A 4/1992 Caillat et al.

(Continued)

FOREIGN PATENT DOCUMENTS

CN 2900866 Y 5/2007
CN 101910637 A 12/2010

(Continued)

OTHER PUBLICATIONS

Office Action and Search Report regarding Chinese Patent Application No. 201711330061.4, dated Nov. 5, 2018. Translation provided by Unitalen Attorneys at Law.

(Continued)

*Primary Examiner* — Theresa Trieu
(74) *Attorney, Agent, or Firm* — Harness, Dickey & Pierce, P.L.C.

(57) ABSTRACT

Scroll compressor designs are provided to minimize vibration, sound, and noise transmission. The scroll compressor has a bearing housing, and orbiting and non-orbiting scroll members. The non-orbiting scroll member has a radially extending flanged portion with at least one aperture substantially aligned with the axially extending bore. At least one fastener is disposed within the aperture and the bore. A sound isolation member contacts at least one of the non-orbiting scroll member, the fastener, or the bearing housing, to reduce or eliminate noise transmission. The sound isolation member may be formed of a polymeric composite having an acoustic impedance value greater than the surrounding materials. The sound isolation member may be an annular washer, an O-ring, or a biasing member, by way of non-limiting example. In other variations, fluid passages are provided within the fastener and/or bearing housing to facilitate entry of lubricant oil to further dampen sound and noise.

18 Claims, 9 Drawing Sheets

Related U.S. Application Data

(60) Provisional application No. 61/909,831, filed on Nov. 27, 2013.

(51) Int. Cl.

| | |
|---|---|
| ***F04C 2/00*** | (2006.01) |
| ***F04C 29/06*** | (2006.01) |
| ***F04C 18/02*** | (2006.01) |
| ***F01C 1/02*** | (2006.01) |
| ***F04C 27/00*** | (2006.01) |
| ***F04C 15/00*** | (2006.01) |
| ***F04C 29/00*** | (2006.01) |
| ***F04C 29/02*** | (2006.01) |
| *F04C 23/00* | (2006.01) |
| *F04C 28/24* | (2006.01) |

(52) U.S. Cl.

CPC ..... *F04C 18/0215* (2013.01); *F04C 27/005* (2013.01); *F04C 27/007* (2013.01); *F04C 29/0021* (2013.01); *F04C 29/026* (2013.01); *F04C 29/063* (2013.01); *F01C 1/0253* (2013.01); *F04C 23/008* (2013.01); *F04C 28/24* (2013.01); *F04C 2230/91* (2013.01); *F04C 2240/50* (2013.01); *F04C 2240/805* (2013.01); *F04C 2240/807* (2013.01); *F04C 2270/13* (2013.01); *F05C 2203/02* (2013.01); *F05C 2225/00* (2013.01); *F05C 2225/04* (2013.01); *F05C 2225/06* (2013.01); *F05C 2251/042* (2013.01); *F05C 2253/04* (2013.01)

(58) Field of Classification Search

CPC .... F04C 23/008; F04C 27/005; F04C 27/007; F04C 29/0057; F04C 29/065; F04C 29/06; F04C 29/063; F04C 29/068; F01C 1/0215; F01C 1/0253; F05C 2225/04; F05C 2225/00; F05C 2253/04; F05C 2225/06

USPC ..... 418/55.1–55.6, 57, 151

See application file for complete search history.

(56) References Cited

U.S. PATENT DOCUMENTS

| | | | | |
|---|---|---|---|---|
| 5,383,772 | A | 1/1995 | Richardson, Jr. et al. | |
| 5,445,507 | A | 8/1995 | Nakamura et al. | |
| 5,547,355 | A | 8/1996 | Watanabe et al. | |
| 5,951,271 | A | 9/1999 | DuMoulin et al. | |
| 6,027,321 | A | 2/2000 | Shim et al. | |
| 6,345,966 | B1 | 2/2002 | Hahn et al. | |
| 6,464,479 | B1 | 10/2002 | Saunders | |
| 6,821,092 | B1 | 11/2004 | Gehret et al. | |
| 7,322,807 | B2 | 1/2008 | Clendenin et al. | |
| 2005/0220652 | A1 | 10/2005 | Yamaji et al. | |
| 2006/0204378 | A1 | 9/2006 | Anderson | |
| 2009/0071183 | A1 | 3/2009 | Stover et al. | |
| 2010/0303659 | A1 | 12/2010 | Stover et al. | |
| 2012/0098176 | A1* | 4/2012 | Matsushita | F16F 13/08 267/140.13 |
| 2012/0285150 | A1* | 11/2012 | Kameda | F03D 15/00 60/325 |
| 2013/0251574 | A1 | 9/2013 | Heusler et al. | |

FOREIGN PATENT DOCUMENTS

| | | |
|---|---|---|
| CN | 103122855 A | 5/2013 |
| JP | 0400549 | 1/1992 |

OTHER PUBLICATIONS

Notification of Grounds for Refusal corresponding to Korean Application No. 10-2016-7016250 dated Dec. 29, 2017.

International Search Report and Written Opinion of the International Searching Authority regarding International Application No. PCT/US2014/067716, dated Mar. 10, 2015.

Office Action regarding U.S. Appl. No. 14/553,502, dated Aug. 10, 2016.

Office Action regarding Chinese Patent Application No. 201480065061.4, dated Feb. 4, 2017. Translation provided by Unitalen Attorneys at Law.

Office Action regarding Chinese Patent Application No. 201480065061.4, dated Jul. 10, 2017. Translation provided by Unitalen Attorneys at Law.

Search Report regarding European Patent Application No. 14865917.0, dated Jul. 31, 2017.

Office Action regarding Chinese Patent Application No. 201711330061.4, dated Jun. 6, 2019. Translation provided by Unitalen Attorneys at Law.

Non-Final Office Action regarding U.S. Appl. No. 15/633,513 dated Mar. 7, 2019.

Final Office Action regarding U.S. Appl. No. 15/633,513 dated Jul. 11, 2019.

* cited by examiner

COMPRESSOR HAVING SOUND ISOLATION FEATURE

CROSS-REFERENCE TO RELATED APPLICATIONS

This application is a divisional of U.S. patent application Ser. No. 14/553,502 filed on Nov. 25, 2014. This application claims the benefit of U.S. Provisional Application No. 61/909,831, filed on Nov. 27, 2013. The entire disclosure of the above applications are incorporated herein by reference.

FIELD

The present disclosure relates to a compressor, and more particularly, to a compressor having a sound isolation feature.

BACKGROUND

This section provides background information related to the present disclosure and is not necessarily prior art.

Compressors may be used in heating and cooling systems and/or other working fluid circulation systems to compress and circulate a working fluid (e.g., refrigerant) through a fluid circuit having a heat exchanger and an expansion device. A scroll compressor can compress a fluid from a suction pressure to a discharge pressure greater than the suction pressure using a non-orbiting scroll member and an orbiting scroll member, each having a wrap positioned in meshing engagement with one another. The relative movement between the scroll members causes the fluid pressure to increase as the fluid moves from the suction inlet opening to the discharge port.

Efficient and reliable operation of the compressor is desirable to ensure that the system in which the compressor is installed is capable of effectively and efficiently providing a cooling and/or heating effect on demand. When the compressive capacity of the compressor is reduced (e.g., due to a capacity modulation event), such that the relative orbital movement between the orbiting scroll member and the non-orbiting scroll member is varied, the compressor may produce undesirable vibrations, sounds and noises.

SUMMARY

This section provides a general summary of the disclosure, and is not a comprehensive disclosure of its full scope or all of its features.

The present disclosure provides scroll compressor designs having improved sound isolation, thus minimizing vibration and sound transmission. In certain variations, the present disclosure provides a scroll compressor comprising a bearing housing including at least one radially extending arm having an axially extending bore. The scroll compressor also comprises an orbiting scroll member and a non-orbiting scroll member. The orbiting scroll member includes a first end plate and a first scroll wrap extending from the first end plate. The non-orbiting scroll member includes a second end plate, a second scroll wrap extending from the second end plate and meshingly engaged with the first scroll wrap, and a radially extending flanged portion comprising at least one axially extending aperture substantially aligned with the axially extending bore. The scroll compressor further comprises at least one fastener disposed within the aperture and the bore. The non-orbiting scroll member has a first acoustic impedance value. A sound isolation member is disposed between at least a portion of the fastener and at least a portion of the non-orbiting scroll member. The isolation member comprises a composite material comprising a polymer and a plurality of particles. The composite material has a second acoustic impedance value greater than the first acoustic impedance value. The composite material may also have a coefficient of thermal expansion (CTE) of less than or equal to about $1.5\times10^{-3}$ mm/(mm-° K.) for 0.25 mm growth.

In other variations, the present disclosure provides a scroll compressor that comprises a bearing housing including at least one radially extending arm having an axially extending bore. The scroll compressor also comprises an orbiting scroll member and a non-orbiting scroll member. The orbiting scroll member includes a first end plate and a first scroll wrap extending from the first end plate. The non-orbiting scroll member includes a second end plate, a second scroll wrap extending from the second end plate and meshingly engaged with the first scroll wrap. The non-orbiting scroll member also includes a radially extending flanged portion including at least one axially extending aperture substantially aligned with the axially extending bore. The scroll compressor further comprises at least one fastener disposed within the aperture and the bore. A sound isolation member comprises a biasing member operable to bias the non-orbiting scroll member in an axial direction, so as to reduce vibration and sound generated by movement of the non-orbiting scroll member during scroll compressor operation.

In yet other variations, a scroll compressor is provided that comprises a bearing housing including at least one radially extending arm having an axially extending bore. The scroll compressor comprises an orbiting scroll member and a non-orbiting scroll member. The orbiting scroll member includes a first end plate and a first scroll wrap extending from the first end plate. The non-orbiting scroll member includes a second end plate, a second scroll wrap extending from the second end plate and meshingly engaged with the first scroll wrap, and a radially extending flanged portion. The radially extending flanged portion including at least one axially extending aperture substantially aligned with the axially extending bore. The scroll compressor also comprises at least one fastener having a first portion disposed within the aperture and a second portion disposed within the bore. At least one annular washer is disposed about the fastener, where the at least one annular washer comprises a composite material comprising a polymer and a plurality of particles.

In other aspects, the present disclosure provides a scroll compressor. The scroll compressor comprises a bearing housing including at least one radially extending arm having an axially extending bore. The scroll compressor also comprises an orbiting scroll member and a non-orbiting scroll member. The orbiting scroll member includes a first end plate and a first scroll wrap extending from the first end plate. The non-orbiting scroll member includes a second end plate, a second scroll wrap extending from the second end plate and meshingly engaged with the first scroll wrap. The non-orbiting scroll member also has a radially extending flanged portion having a first surface and a second surface, and including at least one aperture extending axially between the first surface and the second surface. The aperture is substantially aligned with the axially extending bore. At least one sleeve guide is disposed within the aperture. Further, at least one fastener has a first portion disposed within the sleeve guide and a second portion disposed within the bore. An O-ring member is disposed about the fastener and operable to sealingly divide an interface between the sleeve guide and the aperture into a first axial portion and a second axial portion.

In yet other aspects, the present disclosure provides a scroll compressor that comprises a bearing housing including at least one radially extending arm having an axially extending fastener bore. The scroll compressor also comprises an orbiting scroll member and a non-orbiting scroll member. The orbiting scroll member includes a first end plate and a first scroll wrap extending from the first end plate, the orbiting scroll operable to orbit about a first axis. The non-orbiting scroll member includes a second end plate, a second scroll wrap extending from the second end plate and meshingly engaged with the first scroll wrap, and a radially extending flanged portion. The radially extending flanged portion has a first surface and a second surface and includes at least one aperture extending axially between the first surface and the second surface. The aperture is substantially aligned with the axially extending fastener bore. The at least one fastener is disposed within the aperture and the fastener bore. The fastener has a first passage extending in a direction substantially parallel to the first axis, and a second passage extending in a direction substantially perpendicular to the first axis. The second passage is operable to fluidly communicate with the first passage.

In other aspects, the present disclosure further provides a scroll compressor comprising a bearing housing including a first passage, a second passage, a counterweight cavity, and at least one radially extending arm having an axially extending fastener bore. The scroll compressor further comprises an orbiting scroll member and a non-orbiting scroll member. The orbiting scroll member includes a first end plate and a first scroll wrap extending from the first end plate. The non-orbiting scroll member includes a second end plate, a second scroll wrap extending from the second end plate and meshingly engaged with the first scroll wrap, and a radially extending flanged portion having a first surface and a second surface, and including at least one aperture extending axially between the first surface and the second surface. The aperture is substantially aligned with the fastener bore. At least one sleeve guide is disposed within the aperture, where the sleeve guide includes a third passage. At least one fastener has a first portion disposed within the sleeve guide and a second portion disposed within the bore. The first passage is operable to fluidly communicate with the counterweight cavity and the second passage. The second passage is operable to fluidly communicate with the third passage. The third passage is operable to fluidly communicate with an interface between the sleeve guide and the aperture.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
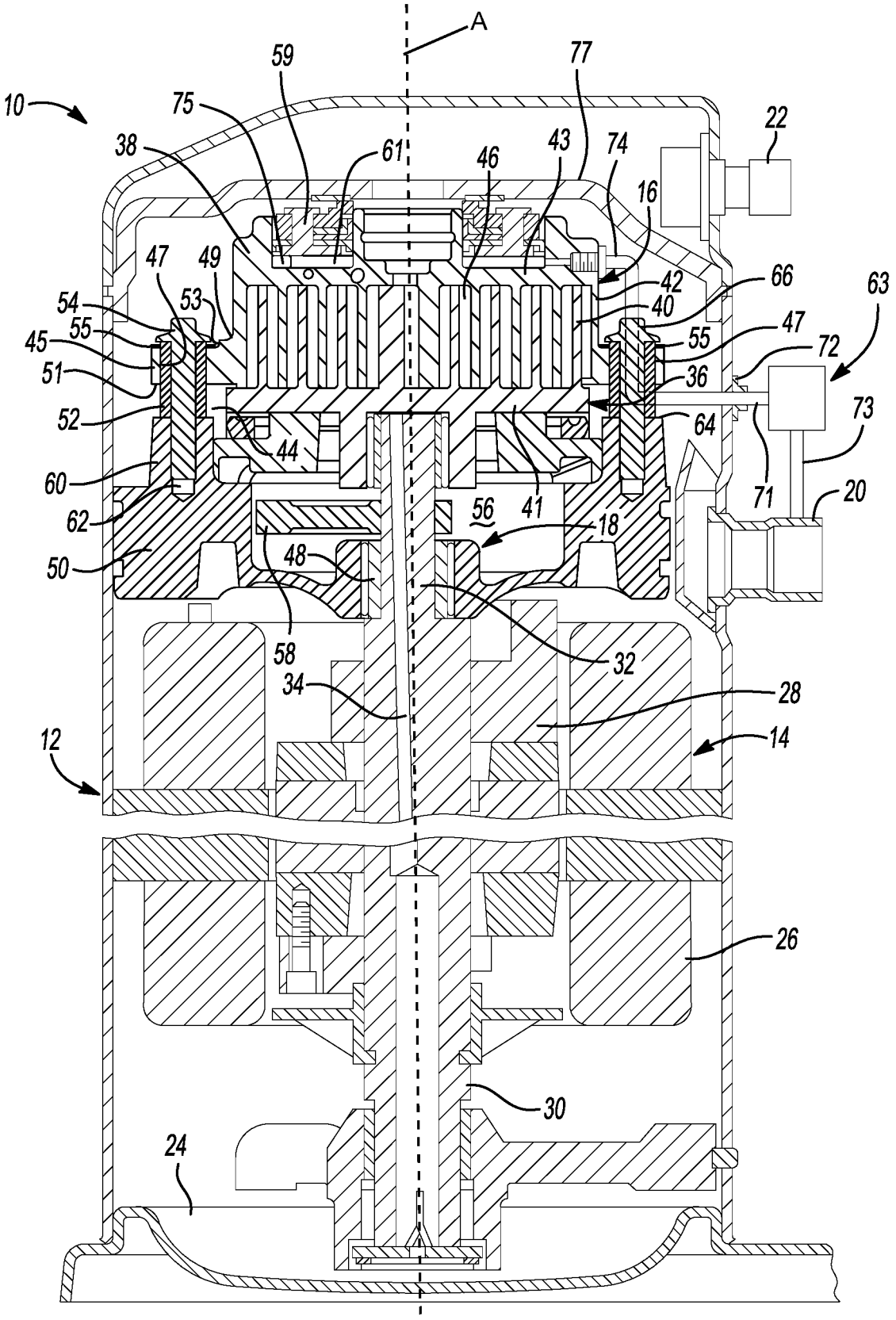
FIG. 1 is a cross-sectional view of a scroll compressor in accordance with certain aspects of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is shown to include a hermetic shell assembly 12, a motor assembly 14, a compression mechanism 16, and a bearing housing assembly 18. The shell assembly 12 may house the motor assembly 14, the compression mechanism 16, and the bearing housing assembly 18. The shell assembly 12 may include a suction inlet port 20 receiving a working fluid at a suction pressure from one of an indoor or outdoor heat exchanger (not shown) and a discharge outlet port 22 discharging the working fluid to the other of the indoor or outdoor heat exchanger after it has been compressed by the compression mechanism 16. A bottom portion of the shell assembly 12 may form a reservoir or sump 24 containing a volume of a lubricant (e.g., oil).

The motor assembly 14 may include a motor stator 26, a rotor 28, and a drive shaft 30. The motor stator 26 may be press fit into the shell assembly 12. The rotor 28 may be press fit on the drive shaft 30 and may transmit rotational power to the drive shaft 30. The drive shaft 30 may include an eccentric crank pin 32 drivingly engaging the compression mechanism 16. The drive shaft 30 may also include a lubricant passageway 34 extending therethrough and communicating with the lubricant sump 24.

The compression mechanism 16 may include an orbiting scroll member 36 and a non-orbiting scroll member 38. The non-orbiting scroll member 38 may be fixed to the bearing housing assembly 18 by a plurality of fasteners 54, such as threaded bolts or similar attachment features. The orbiting and non-orbiting scroll members 36, 38 include orbiting and non-orbiting spiral wraps 40, 42, respectively, that meshingly engage each other and extend from orbiting and non-orbiting end plates 41, 43, respectively. An Oldham coupling 44 may be keyed to the orbiting scroll member 36 and a stationary structure (e.g., the bearing housing assembly 18 or the non-orbiting scroll member 38) to prevent relative rotation between the orbiting and non-orbiting scroll members 36, 38 while allowing the orbiting scroll member 36 to move in an orbital path about an axis A relative to the non-orbiting scroll member 38. Moving fluid pockets 46 are formed between the orbiting and non-orbiting spiral wraps 40, 42 that decrease in size as they move from a radially outer position to a radially inner position, thereby compressing the working fluid therein from the suction pressure to the discharge pressure.

The non-orbiting scroll member 38 may include at least one radially extending flanged portion 45. The at least one radially extending flanged portion 45 may include a plurality of apertures 47 extending in an axial direction between an upper or first surface 49 and a lower or second surface 51 of the flanged portion 45. The first surface 49 may include an axially recessed portion 53. In one configuration, the axially recessed portion 53 may be a plurality of counter bore features that are concentric to the apertures 47.

The bearing housing assembly 18 may include a first bearing 48, a main bearing housing 50, and a plurality of sleeves guides 52. The main bearing housing 50 may house the first bearing 48, which rotatably supports the drive shaft 30. The main bearing housing 50 may define a counterweight cavity 56 between the first bearing 48 and the orbiting scroll member 36. A counterweight 58 attached to the drive shaft 30 may rotate within the counterweight cavity 56. The sleeve guides 52 may be generally elongated tubes or washer-like members. The sleeve guides 52 can be disposed within the plurality of apertures 47.

The main bearing housing 50 may include a plurality of radially extending arms 60 fixedly engaging an interior surface of the shell assembly 12. Each of the radially extending arms 60 may include a first axially extending bore 62. The bore 62 may be a threaded bore. Thus, the sleeve guides 52 may extend through the apertures 47 of the non-orbiting scroll member 38 and engage a first surface 64 of the radially extending arms 60 of the main bearing housing 50. The fasteners 54 may be received in, and extend through, the sleeve guides 52 and threadingly engage the bore 62 to secure the sleeve guides 52 to the main bearing housing 50. A relatively small space (e.g., approximately twenty-eight thousandths (0.028) of a millimeter) may exist between the sleeve guides 52 and the apertures 47 in the non-orbiting scroll member 38 to facilitate assembly. Likewise, a relatively small space (e.g., approximately three hundred five thousandths (0.305) of a millimeter) may exist between the fasteners 54 and the sleeve guides 52 to further facilitate assembly.

During operation of compression mechanism 16 in compressor 10, axial biasing typically facilitates bringing a terminal tip of non-orbiting spiral wrap 42 (of the non-orbiting scroll member 38) into close proximity or contact with orbiting end plate 41 (of the orbiting scroll 36), as well as bringing a terminal tip of orbiting spiral wrap 40 (of orbiting scroll member 36) into close proximity or contact with non-orbiting end plate 43 (of non-orbiting scroll member 38). Such axial biasing or axial compliance allows the non-orbiting scroll member 38 to move slightly in the axial direction to engage the non-orbiting scroll member 38 and the orbiting scroll member 36 together with an optimal range of force to increase efficiency during operation. Thus, during operation of the compression mechanism 16, some amount of axial translation between orbiting scroll member 36 and non-orbiting scroll 38 occurs, which can likewise cause movement with respect to the fixed components, such as the bearing housing assembly 18 and shell assembly 12, for example. Moreover, in certain compressor designs, capacity modulation may intentionally create temporary gaps between a terminal tip of non-orbiting spiral wrap 42 and orbiting end plate 41 and a terminal tip of orbiting spiral wrap 40 with non-orbiting end plate 43.

For example, in certain modulated capacity compressor designs, a piston (not shown here, but described in U.S. Publication No. 2009/0071183 by way of non-limiting example and incorporated herein by reference in its entirety) can be attached to the non-orbiting scroll member 38. When the piston moves, the non-orbiting scroll member 38 also moves. A solenoid valve (not shown here) can be used to create two different operating conditions around the piston. For example, when the solenoid valve is in the closed position, the pressure on either side of the piston is discharged and a spring force loads the orbiting scroll member 36 and non-orbiting scroll member 38 in near proximity to or contact with one another. When the solenoid valve is energized, a low pressure condition is created that causes the piston to move and consequently the non-orbiting scroll member 38 likewise moves. Thus, the orbiting scroll member 36 and non-orbiting scroll member 38 are separated from one another and no mass flows through when the solenoid valve is energized. The axial movement of the non-orbiting scroll member 38 is typically minimal, for example, about 1 mm, which means that the amount of pressure that bleeds from the high side to the low side is relatively low. De-energizing the external solenoid valve again loads the compressor 10 fully and the compression of working fluid is resumed within the compression mechanism 16. However, when the non-orbiting scroll member 38 unloads during a modulation event, the motion and vibration can cause undesirably high sound levels. While some conventional approaches have attempted to dampen sound in scroll compressors, many of such conventional materials have failed to achieve long-term noise reduction and acoustic attenuation, because of insufficient sound reduction and/or high levels of fatigue and swelling for conventional materials and designs.

With reference to FIG. 1, in other modulated capacity compressor designs, an annular floating seal 59 can be supported by the non-orbiting scroll member 38. The annular floating seal 59 can be used to separate the discharge gas pressure from the suction gas pressure. In this regard, the non-orbiting scroll member 38 can include in the upper surface thereof an annular recess 61 having parallel coaxial side walls in which the annular floating seal 59 is sealingly disposed for relative axial movement. A solenoid valve 63 can be used to create two different operating conditions around the annular floating seal 59. The solenoid valve 63 can be located outside of the shell 12, and a fluid pipe 71 can extend through a fitting 72 attached to the shell 12 to place the solenoid valve 63 in fluid communication with the recess 61. A fluid pipe 73 extends between the solenoid valve 63 and the suction inlet port 20 to place the solenoid valve 63 in fluid communication with the suction pressure of the compressor 10. The solenoid valve 63 is operable to open and close a passageway 74 at least partially located within the non-orbiting scroll 38. The passageway 74 extends from the bottom of the recess 61, which can be at intermediate pressure during operation of the compressor 10, to an area of compressor 10 which contains suction gas at suction gas pressure.

In operation, when system operating conditions (e.g., load conditions) are such that the full capacity of the compressor 10 is not required, sensors (not shown) can provide a signal indicative thereof to a control module (not shown) which in turn will de-energize the solenoid valve 63, thereby placing the passageway 74 in communication with the suction area of the compressor 10. Intermediate pressure within the annular recess 61 will be exhausted or vented through the passageway 74 to remove the biasing force urging the non-orbiting scroll member 38 into sealing engagement with the orbiting scroll member 36. A spring 75 can urge the floating seal 59 upwards and maintain a sealing relationship with a partition 77 separating the discharge pressure from the suction pressure, and the non-orbiting scroll 38 will be biased away from orbiting scroll member 36. Accordingly, as the annular floating seal 59 moves, the non-orbiting scroll member 38 can be moved toward and away from the orbiting scroll member 36, generating noises as the non-orbiting scroll member 38 engages the fasteners 54, for example.

Figure 2B:
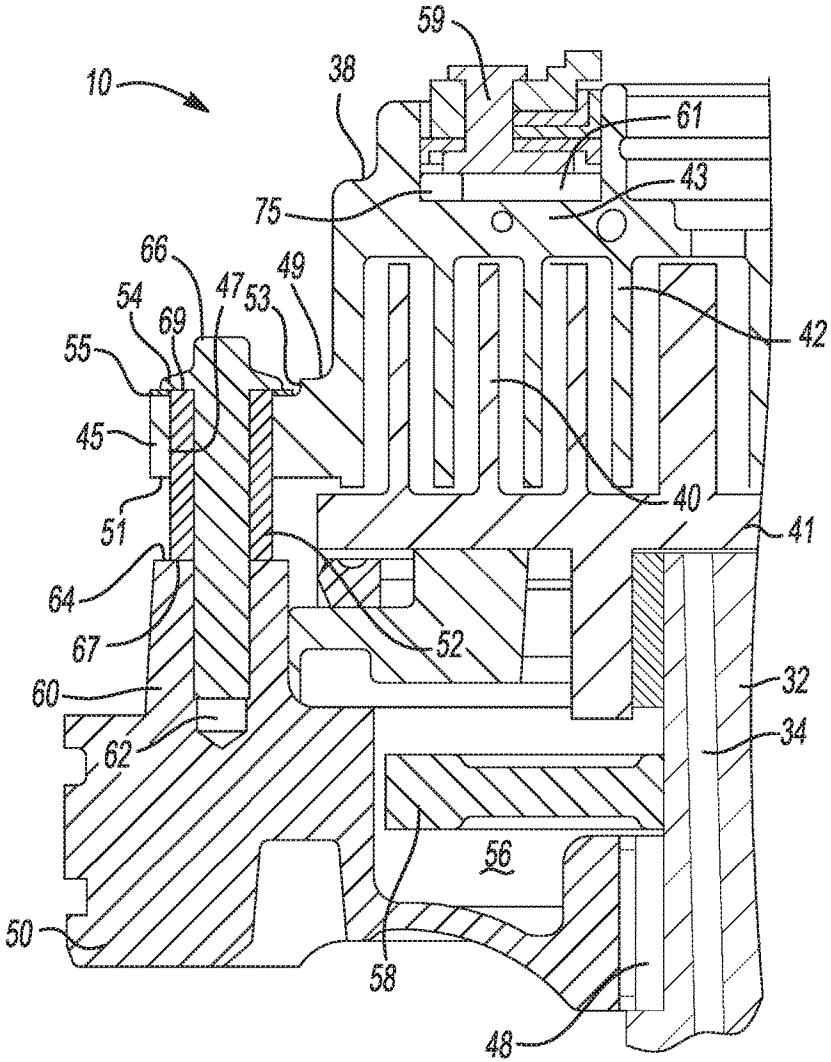
FIGS. 2A and 2B are partial cross-sectional views of the compressor of FIG. 1, including a sound isolation feature according to certain variations of the present disclosure.
Figure 2A:
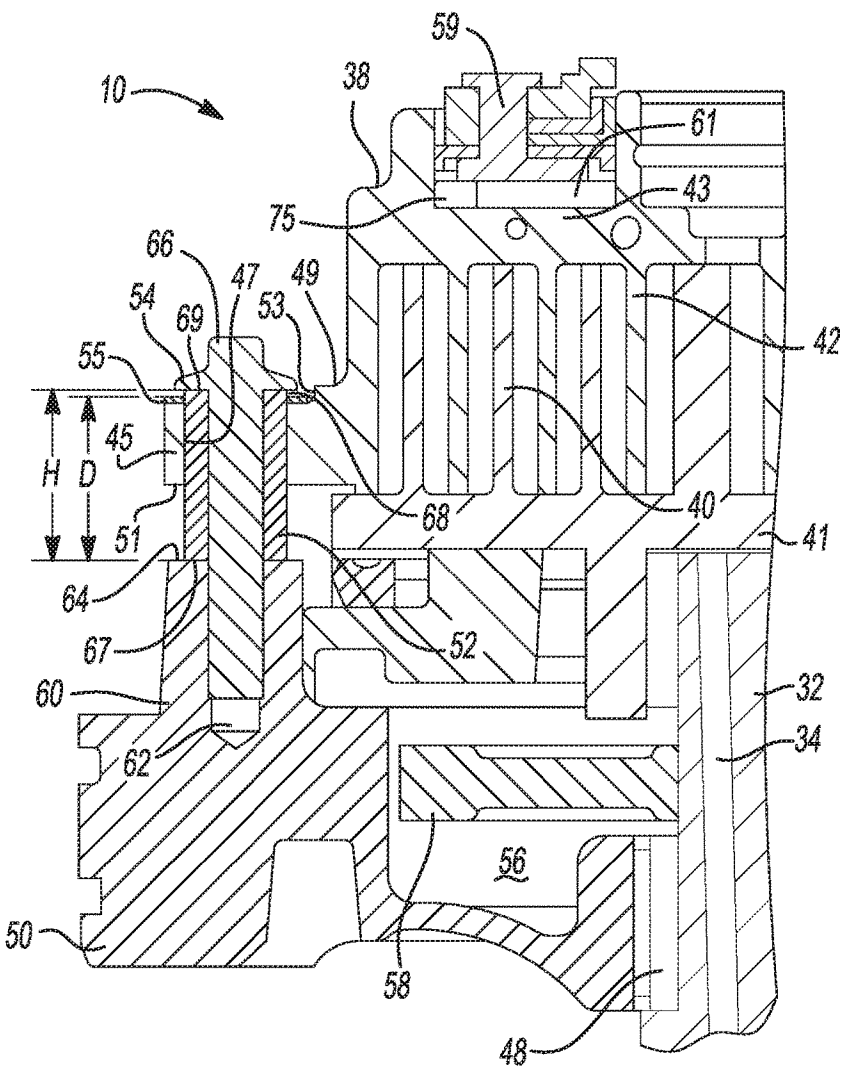

Thus, in accordance with various aspects of the present disclosure, various sound isolation features or components within the compressor 10 are designed to provide superior noise reduction and sound attenuation for scroll compressors, as compared to conventional techniques. Notably, in certain aspects, a noise reduction technique employs a sound isolation material disposed within a sound transmission pathway where the wave would otherwise pass. For example, as shown in FIGS. 1 and 2A-2B, the axially recessed portion 53 within the at least one radially extending flanged portion 45 of non-orbiting scroll member 38 may include a sound isolation member 55. A sound isolation member, like the sound isolation member 55, in certain variations may be a disk-like member formed from a non-metallic material.

In certain aspects, the sound isolation member according to the present disclosure may be formed from a material having a first acoustic impedance value that differs from a second acoustic impedance value of the non-orbiting scroll member 38 and/or the fasteners 54. Specific acoustic impedance (Z) for a given material is defined as:

$$Z=\rho V \quad \text{(Equation 1)}$$

where ρ is the material's density and V is the acoustic velocity of the material. Acoustic impedance can also be understood to be a ratio of a pressure over an imaginary surface in a sound wave to a rate of particle flow across the surface (e.g., a ratio of acoustic pressure (p) to acoustic volume flow (U)). Acoustic impedance can be used to determine acoustic transmission and reflection at a boundary between two distinct materials having different acoustic impedance values. Further, acoustic impedance relates to a material's ability to absorb sound. In various aspects, a difference in acoustic impedance is maximized, for example, between a first acoustic impedance of the sound isolation member or feature and a second acoustic impedance of adjacent materials, like the non-orbiting scroll member 38. In certain aspects, the acoustic impedance mismatch provides sound and noise reduction resulting from chatter and vibration, rather than employing a dampening mechanism.

In yet other aspects, the sound isolation member (e.g., sound isolation member 55) may be formed from a sound isolation material that fulfills one or more of the following properties: has a compressive modulus within desired ranges that provides a desired fatigue life, has a coefficient of thermal expansion (CTE) within desired ranges, and reduced volume swell. For example, certain particularly suitable materials for the sound isolation member include a polymeric composite that comprises at least one polymer (e.g., a polymer matrix) with particles dispersed therein. In certain aspects, the composite includes filler particles distributed homogeneously or evenly throughout the polymer matrix.

In certain variations, the sound isolation material composite may comprise a total amount of a plurality of particles of greater than or equal to about 25% by weight to less than or equal to about 95% by weight, optionally greater than or equal to about 30% by weight to less than or equal to about 90% by weight, optionally greater than or equal to about 50% by weight to less than or equal to about 75% by weight, optionally greater than or equal to about 55% by weight to less than or equal to about 70% by weight, optionally greater than or equal to about 60% by weight to less than or equal to about 65% by weight of a total amount of particles in the composite. Of course, as appreciated by those of skill in the art, appropriate amounts of particles in a composite material depend upon material properties, and other parameters for a particular type of particle in a specific matrix material.

In certain variations, the sound isolation composite material may comprise a total amount of a polymer (e.g., a matrix material) of greater than or equal to about 5% by weight to less than or equal to about 75% by weight, optionally greater than or equal to about 10% by weight to less than or equal to about 70% by weight, optionally greater than or equal to about 15% by weight to less than or equal to about 65% by weight, optionally greater than or equal to about 25% by weight to less than or equal to about 50% by weight, optionally greater than or equal to about 30% by weight to less than or equal to about 45% by weight, optionally greater than or equal to about 35% by weight to less than or equal to about 40% by weight of a total amount of matrix material in the composite. Again, such values may vary based on the materials and properties desired in the composite material.

Such sound isolation composite materials may have properties tailored to have high fatigue life, yet low sound impedance and a minimal CTE within a desirable range. The CTE is typically defined as a fractional increase in the length per unit rise in temperature. In minimizing volumetric swelling, the sound isolation material permits sufficient space for some travel or axial movement of the non-orbiting scroll to properly unload during capacity modulation, for example.

A suitable compressive modulus range for the sound isolation material takes into consideration both a modulus of the material and a thickness of the sound isolation member. A lower compressive modulus is generally advantageous to provide the desired sound isolation, although the range is usually not so low as to undesirably affect fatigue life (hence, a greater thickness may be used to improve fatigue life). Thus, in certain variations, a compressive modulus of a sound isolation material has a lower limit that is sufficient to avoid premature fatigue and long-term use, while an upper limit for compressive modulus is lower than that of cast iron, for example. Where a sound isolation member includes a polymeric sound isolation composite that comprises a polymer matrix with particles in accordance with certain aspects of the present teachings, the particles or fillers can desirably impact the compressive modulus. For example, where the particles are fibers, the longer the fibers, the higher the compressive modulus. Therefore, in accordance with certain aspects of the present disclosure, a lower compression modulus is more desirable to provide the desired sound isolation, thus a length of fillers, such as a length of fibers, is limited to relatively low values.

In other aspects, the sound isolation material selected for use in a sound isolation member in accordance with certain aspects of the present disclosure has a coefficient of thermal expansion (CTE) that is relatively low. Where a sound isolation member is a composite that comprises a polymer with particles; thermoset polymers can provide an ability to avoid undesirable expansion with temperature. Further, certain fillers within the composite limit/lower the CTE to avoid expansion, which could cause a no unloading feature. In certain aspects, particles that comprise glass (e.g., silicon dioxide, borosilicates, and the like), carbon-containing fillers, and combinations thereof, provide a desirable lowering of CTE values. Furthermore, where the particles in the composite are fibers, longer fibers tend to lower the CTE relatively more than shorter fibers. In certain variations, a maximum CTE is about $8.9\times10^{-3}$ mm/(mm-° K.) (which does not include a swell factor) for 1.5 mm growth. In other variations, a maximum CTE is about $1.5\times10^{-3}$ mm/(mm-° K.) (which does not include a swell factor) for 0.25 mm growth. Such values are suitable where inputs are 121° C. difference or change is temperature and popoff is as low as 0.25 mm and as high as 1.5 mm. In other aspects, the volume swell as a percentage is minimized.

In certain variations, a particularly suitable sound isolation material for a sound isolation member comprises a polyester composite having glass fiber particles distributed therein. For example, a thermoset vinyl ester having glass fibers that forms a composite is particularly suitable and provides the desired compressive modulus, CTE, and life fatigue. Thus, in one variation, the glass fibers in the composite may have a nominal length of about 1 inch. The glass fiber particles can be present at about 63% by weight percent particles in the composite (where the polymer matrix material is present at about 37% by weight in the composite). Such a composite has a compressive modulus of about 18.6 GPa, and a CTE of about $1.5\times10^{-5}$ 1/° C. is commercially available as QC8800™ from Quantum Composites, Bay City, Mich. QC 8800 is a polyester hybrid engineered structural composite molding compound designed for compression molding of components requiring high structural strength. It exhibits high toughness for applications where impact and rough handling may occur and also provides excellent fatigue resistance. Thus, in one configuration, the sound isolation member 55 may be formed from a composite comprising a polyester and glass fiber. Such a sound isolation member 55 may have an annular shape and serve as a washer, for example.

In another variation, a sound isolation feature may be in the form of a non-metallic coating disposed on an outer surface of the sleeve guides 52. In one configuration, the outer surface of the sleeve guides 52 may be coated with a flexible or rubberized compound such as WOLVERINE® gasket material commercially available from Wolverine Advanced Materials, which is capable of providing one or more of the desired material properties, discussed above.

With reference to FIGS. 2A and 2B, operation of the compressor 10 and the sound isolation member 55 will now be described in more detail. The height H of the sleeve guides 52 may be greater than a distance D between the first surface 64 of the radially extending arms 60 and the sound isolation member 55, such that there is a space or gap 68 between the head 66 of the fastener 54 and the sound isolation member 55. In an assembled configuration, a first end 67 of the sleeve guide 52 may be in contact with the main bearing housing 50 and a second end 69 of the sleeve guide 52 may be in contact with the head 66 of the fastener 54. In a first position (FIG. 2A), the non-orbiting spiral wrap 42, may engage the orbiting plate 41, such that the gap 68 is present between the sound isolation member 55 and the head 66 of the fastener 54. In the first position, the compressor 10 may be operating in a loaded state, in which the compression mechanism 16 is compressing the working fluid from the suction pressure to the discharge pressure. In a second position (FIG. 2B), the non-orbiting scroll member 38 may move in the axial direction away from the orbiting scroll member 36, such that the non-orbiting scroll member 38 slides via apertures 47 along the sleeve guides 52 until the gap 68 is closed and the fasteners 54 contact the sound isolation members 55.

The sound isolation members 55 may be formed of the sound isolation composite material discussed above and have an annular shape to seat within axially recessed portion 53 while including a centrally disposed hole corresponding to aperture 47 for receiving fasteners 54. In certain aspects, the sound isolation member 55 may be considered to be a washer formed of the sound isolation composite material. Thus, the sound isolation member 55 may have a thickness of greater than or equal to about 0.10 mm to less than or equal to about 10 mm; optionally has a thickness of greater than about 0.25 mm to less than or equal to about 5 mm, optionally greater than about 0.5 mm to less than or equal to about 4 mm, optionally greater than about 0.75 mm to less than or equal to about 3 mm, optionally greater than about 1 mm to less than or equal to about 2 mm, and in certain variations, may have a thickness of about 1.4 to about 1.5 mm.

In certain embodiments, the at least one radially extending flanged portion 45 of non-orbiting scroll member 38 may include a sound isolation member 55 sitting on top of the flange (such as is shown in FIGS. 2A-2B). In certain alternative aspects, the radially extending flange 45 may omit an axially recessed portion 53, and the sound isolation member (e.g., similar to 55) may be a disk-like washer member formed from a non-metallic composite material, where the washer is permitted to swell and expand in a radial direction. It is contemplated that the at least one radially extending flanged portion 45 may be thinner to accommodate such a design.

In yet other variations, a sound isolation member may be a disk-like washer member formed from a non-metallic composite material, where the sound isolation washer is seated on sleeve guide 52 between a head of fastener 54 (e.g., a bolt head), so no modification to the design of at least one radially extending flanged portion 45 is necessary. Such an embodiment is described in more detail in the context of FIG. 11, below.

Figure 3:
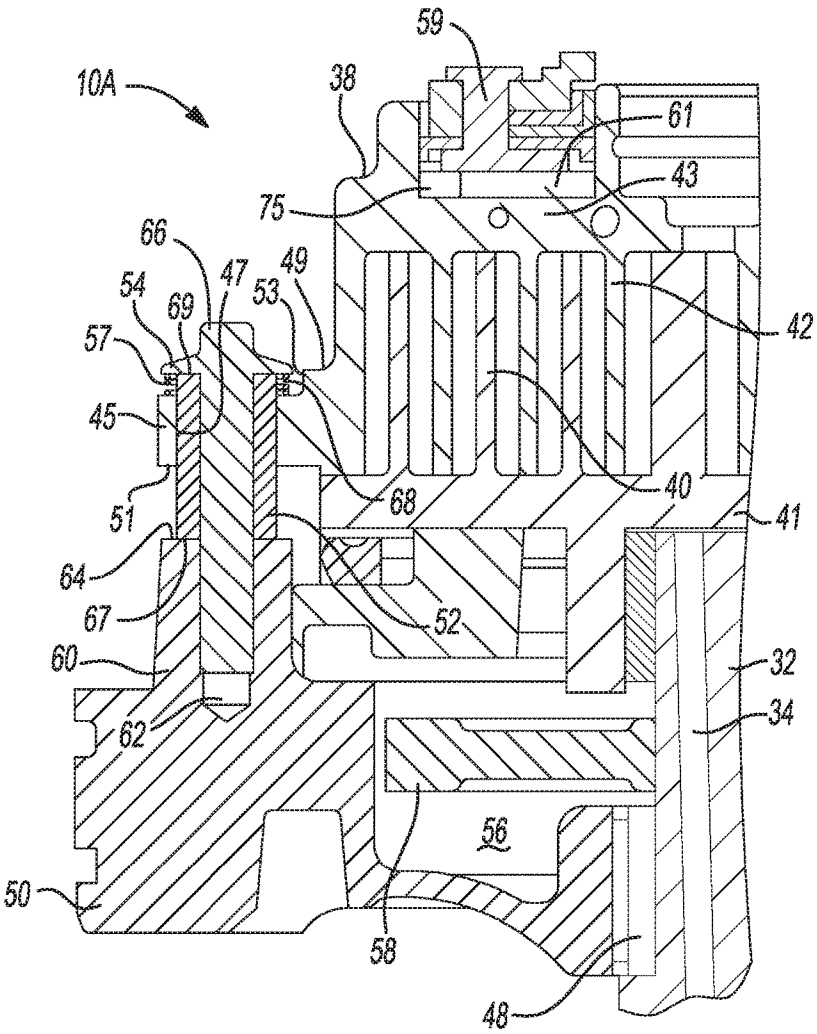
FIG. 3 is a partial cross-sectional view of a scroll compressor showing another configuration of a sound isolation feature according to other aspects of the present disclosure.

With reference to FIG. 3, in other configurations, instead of a sound isolation member in the form of a composite material such as described above, a compressor 10A has a sound isolation member that may be a biasing member 57 such as a helical spring disposed around the fastener 54 and within the aperture 47 or the axially recessed portion 53. Such a biasing member 57 may be formed of a metal material.

Figure 4:
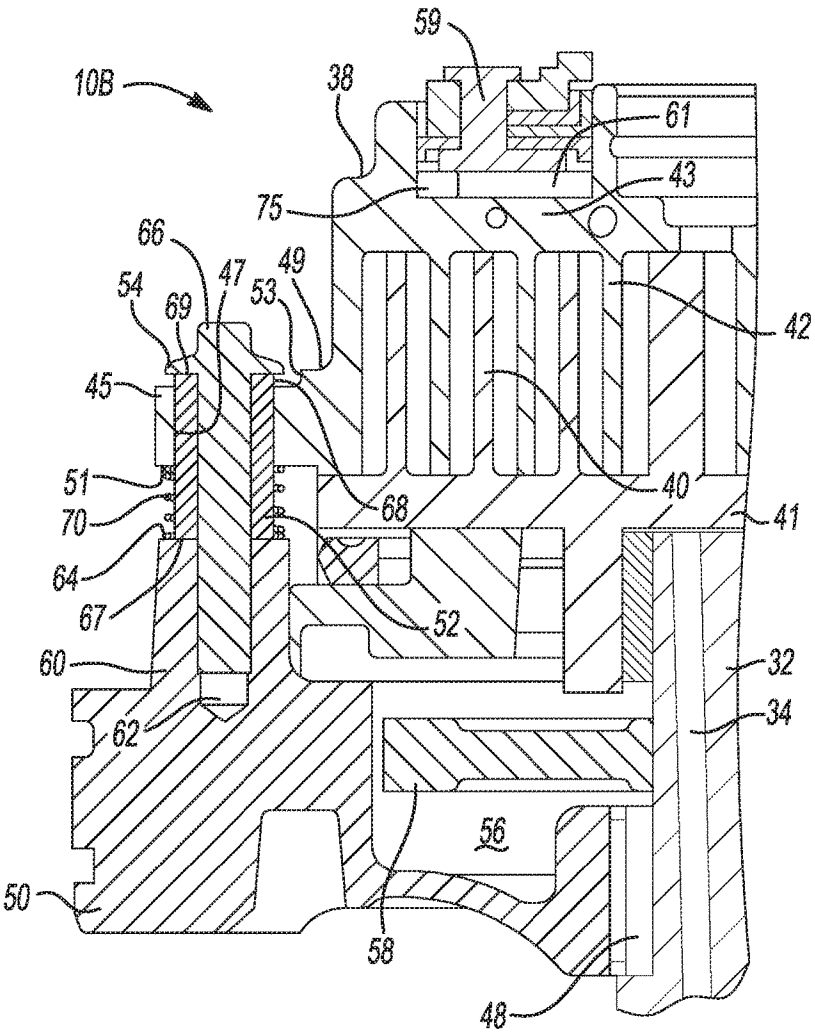
FIG. 4 is a partial cross-sectional view of a scroll compressor showing yet another configuration of a sound isolation feature in accordance with certain aspects of the present disclosure.
Figure 6:
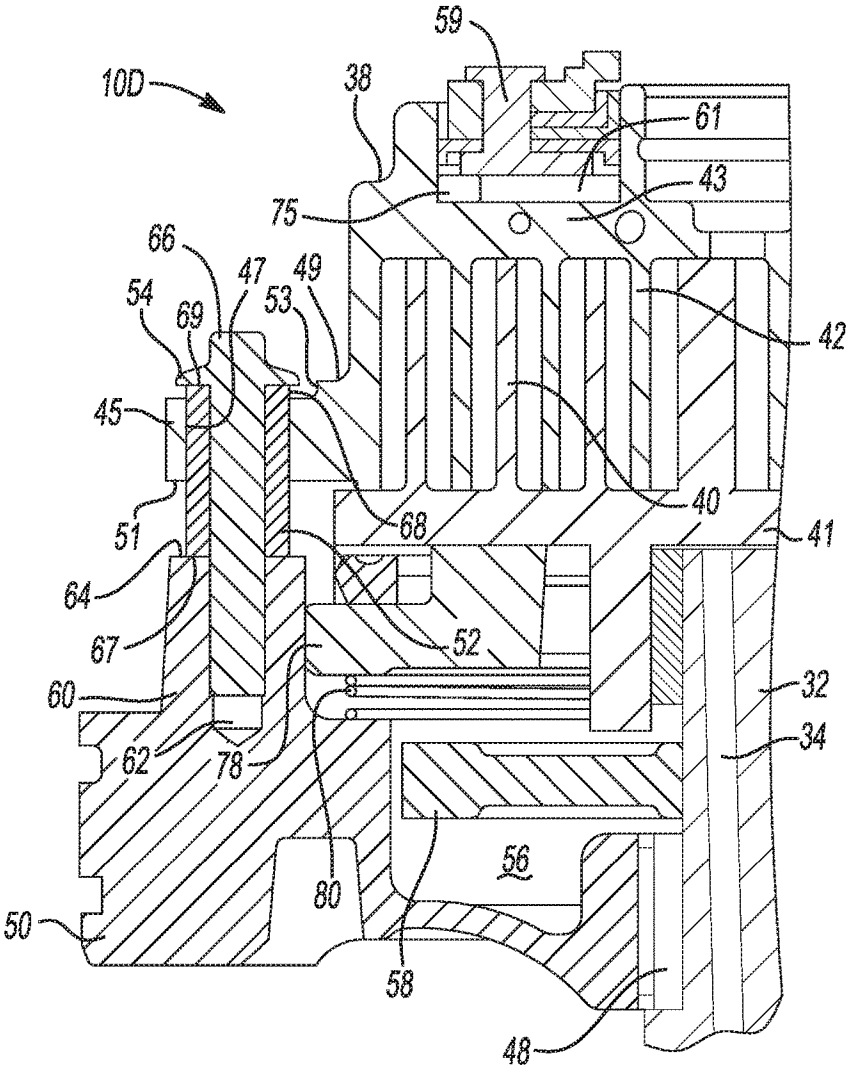
FIG. 6 is a partial cross-sectional view of a scroll compressor showing another alternative configuration of a sound isolation feature in accordance with certain aspects of the present disclosure.
Figure 5:
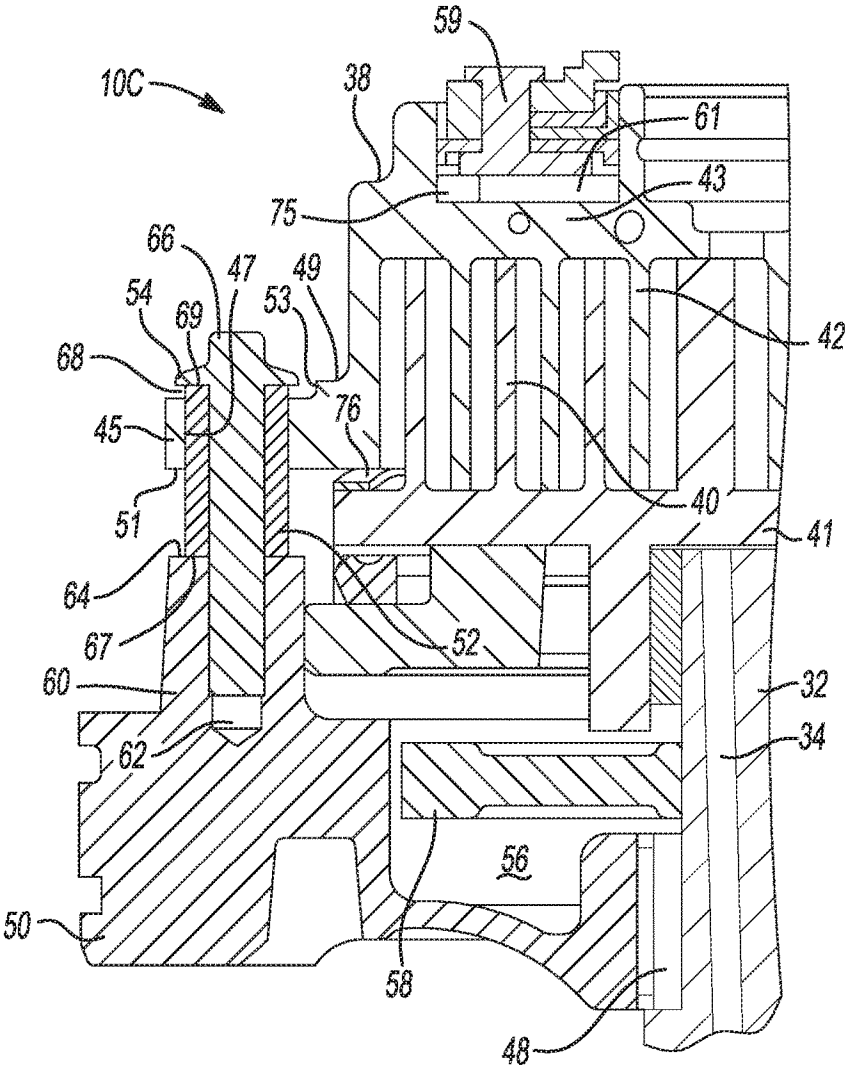
FIG. 5 is a partial cross-sectional view of a scroll compressor showing another alternative configuration of a sound isolation feature in accordance with certain aspects of the present disclosure.

With general reference to FIGS. 4 through 6, other configurations of the compressor (shown as 10B-10D) may include a biasing member as part of a sound isolation design. To the extent that components are the same between different configurations and compressors shown in the various figures, unless otherwise indicated, such components can be assumed to be the same and will not be described herein for the sake of brevity. Notably, the present disclosure contemplates any combination of sound isolation feature(s) or member(s) discussed in the context of one variation with any other variations. As will be described in detail with respect to each configuration, when the compressor is operating in an unloaded condition (e.g., a zero percent capacity or low-capacity operating condition), the biasing force of the biasing member may be sufficient to urge the non-orbiting scroll member 38 into contact with, or in the direction of, the head 66 of each of the fasteners 54. This biasing force can serve to reduce or eliminate chatter or vibration between the non-orbiting scroll member 38 and the fasteners 54.

When the compressor (e.g., 10B-10D) is operating in a loaded condition (e.g., a full or high-capacity operating condition), a force generated by a fluid-pressure differential between a suction chamber and an intermediate-pressure biasing chamber in recess 61 formed in the non-orbiting scroll member 38 may be sufficient to overcome the biasing force of the biasing member to urge the non-orbiting scroll member 38 axially downward into sealing engagement with the orbiting scroll member 36. In this position, the first surface 49 of the non-orbiting scroll member 38 may be spaced apart from the heads of the fasteners 54 and the non-orbiting 38 scroll member may be securely biased against the orbiting scroll member 36.

In other configurations, the biasing members may be otherwise shaped, positioned and/or configured to bias the non-orbiting scroll member 38 against the heads of the fasteners 54 during operation in the unloaded condition and allow the non-orbiting scroll member 38 to be biased against the orbiting scroll member 36 during operation in the loaded condition.

With particular reference to FIG. 4, in one configuration of the compressor 10B, a biasing member 70 may be positioned between the first surface 64 of the main bearing housing 50 and the second surface 51 of the non-orbiting scroll 38. The biasing member 70 may be a helical spring disposed circumferentially around each of the sleeve guides 52. The biasing member 70 may be selectively operable to apply an axial force to the non-orbiting scroll 38 and bias the non-orbiting scroll away from the main bearing housing 50 and the orbiting scroll 36 during unloading of the compressor 10B, thereby improving the unloaded power of the compressor 10B.

With reference to FIG. 5, in yet another configuration of a compressor 10C, at least one biasing member 76 may be positioned between the orbiting and non-orbiting plates 41, 43 of the orbiting and non-orbiting scroll members 36, 38, respectively. The biasing member 76 may be a wave spring, a helical spring, or other similar spring configuration selectively operable to apply an axial force to the orbiting scroll 36 and the non-orbiting scroll 38 and bias the non-orbiting scroll away from the main bearing housing 50 and the orbiting scroll 36 during unloading of the compressor 10C.

With reference to FIG. 6, a compressor 10D may also include a thrust plate 78 disposed between the main bearing housing 50 and the orbiting scroll member 36. Axial forces, generated by the pressure in the moving fluid pockets 46 between the orbiting and non-orbiting spiral wraps 40, 42, may be transferred from the orbiting scroll plate 41 to the main bearing housing 50 through the thrust plate 78. At least one biasing member 80 may be positioned between the thrust plate 78 and the main bearing housing 50. The biasing member 80 may be a wave spring, a helical spring, or other similar spring configuration. The biasing member 80 may be selectively operable to apply an axial force to the thrust plate 78 and the main bearing housing 50 and bias the thrust plate 78 and the orbiting scroll 36 away from the main bearing housing 50 and in the direction of the non-orbiting scroll 38 as pressure is generated in the moving fluid pockets 46 during loading of the compressor 10D.

With reference to FIGS. 7 through 11, in yet other configurations of the compressor (compressors 10E-10I), a sound isolation member in the form of elastomeric or polymeric composite material (a sound insulation material as discussed above) may be used in cooperation with the sleeve guides 52 to reduce the amount of noise generated by the compressor during the unloading process, and therefore improve the operation of the compressor. As noted above, the sound isolation material (e.g., an elastomeric or polymeric material) has an acoustic impedance value that is different from an impedance value of the non-orbiting scroll member 38, the fasteners 54, and/or the sleeve guides 52 to prevent or reduce sound transmission.

Figure 7:
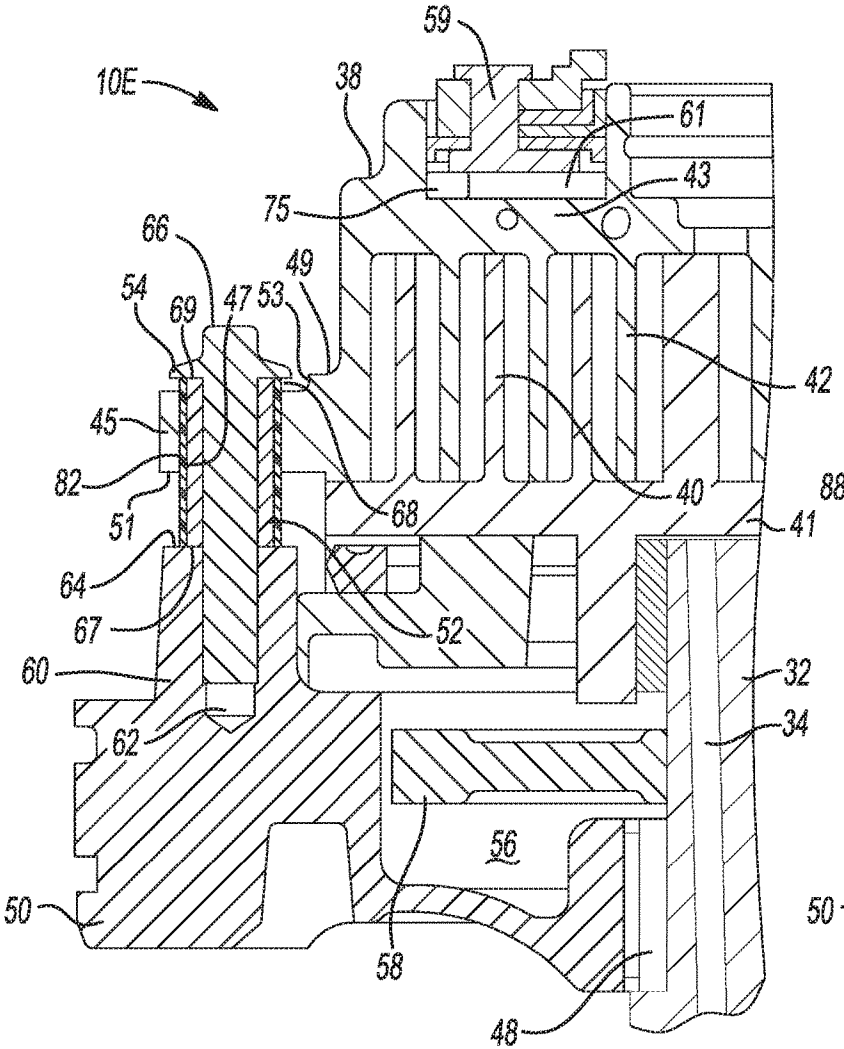
FIG. 7 is a partial cross-sectional view of a scroll compressor showing another alternative configuration of a sound isolation feature in accordance with certain aspects of the present disclosure.

With particular reference to FIG. 7, in one configuration, a sound isolating material (e.g., elastomeric or polymeric composite) may form an annular coating or sleeve 82 on or around the outer surface of the sleeve guide 52. The polymeric sleeve 82 may be integrally formed with the sleeve guide 52 by overmolding or another suitable manufacturing process. Alternatively, the polymeric sleeve 82 may be fixed to the sleeve guide 52 using an adhesive, compression fit, friction weld, or other suitable attachment process. The diameter of the polymeric sleeve 82 may be smaller than the diameter of the apertures 47 in the non-orbiting scroll 38, such that the polymeric sleeve 82 and sleeve guide 52 can be assembled within the apertures 47.

During operation of the compressor 10E in FIG. 7, the polymeric sleeve 82 may reduce the amount of noise generated by, and friction between, the non-orbiting scroll 38 and the sleeve guide 52, as the non-orbiting scroll 38 moves in the axial direction while the compressor 10E is loading and/or unloading, as described above.

Figure 8:
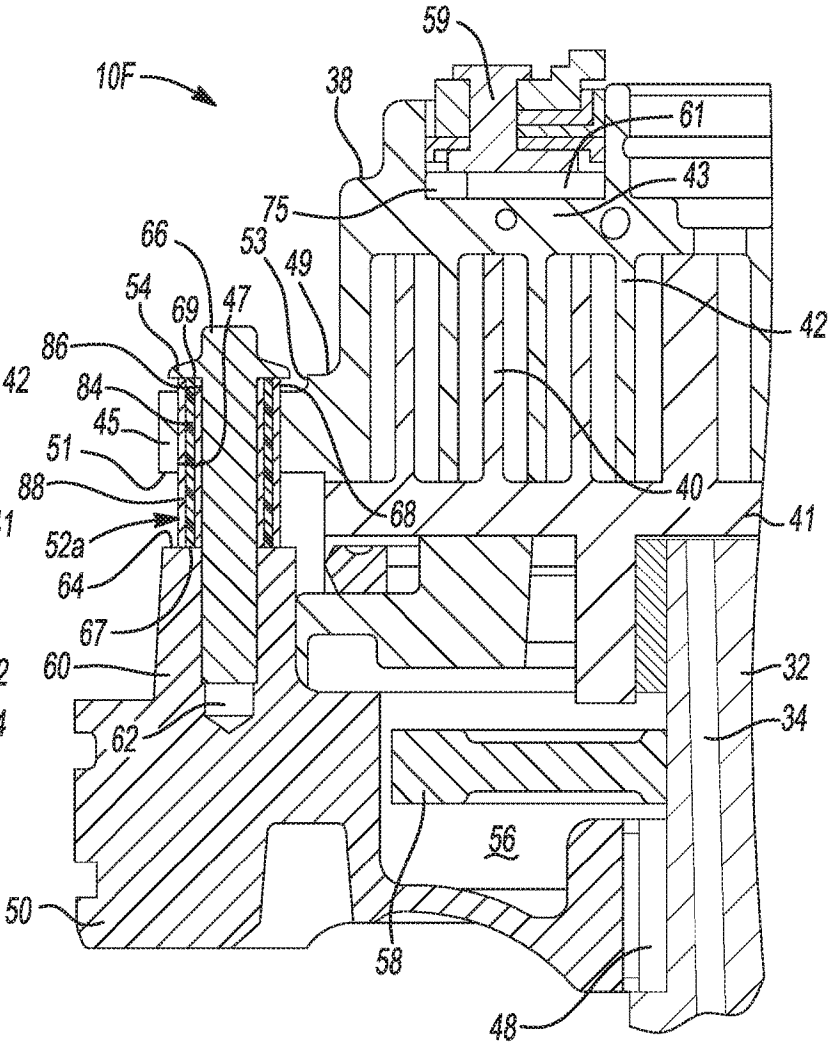
FIG. 8 is a partial cross-sectional view of a scroll compressor showing another alternative configuration of a sound isolation feature in accordance with certain aspects of the present disclosure.

With particular reference to FIG. 8, a sound isolating material may form a polymeric coating or sleeve 84 circumferentially positioned between an inner layer 86 and an outer layer 88 (both of which may be metallic layers) of the sleeve guide 52*a*. The polymeric sleeve 84 may be integrally formed with one of the inner and outer layers 86, 88 of the sleeve guide 52*a* by overmolding or other suitable manufacturing process. Alternatively, the polymeric sleeve 84 may be fixed to one of the inner and outer layer 86, 88 of the sleeve guide 52*a* using an adhesive, compression fit, friction weld, or other suitable process.

During operation of the compressor 10F, the material characteristics of the polymeric sleeve 84, including for example its density and impedance value, reduce the amount of noise that would otherwise be created as the non-orbiting scroll 38 moves in the axial direction during loading and/or unloading of the compressor 10F, as described above.

Figure 9:
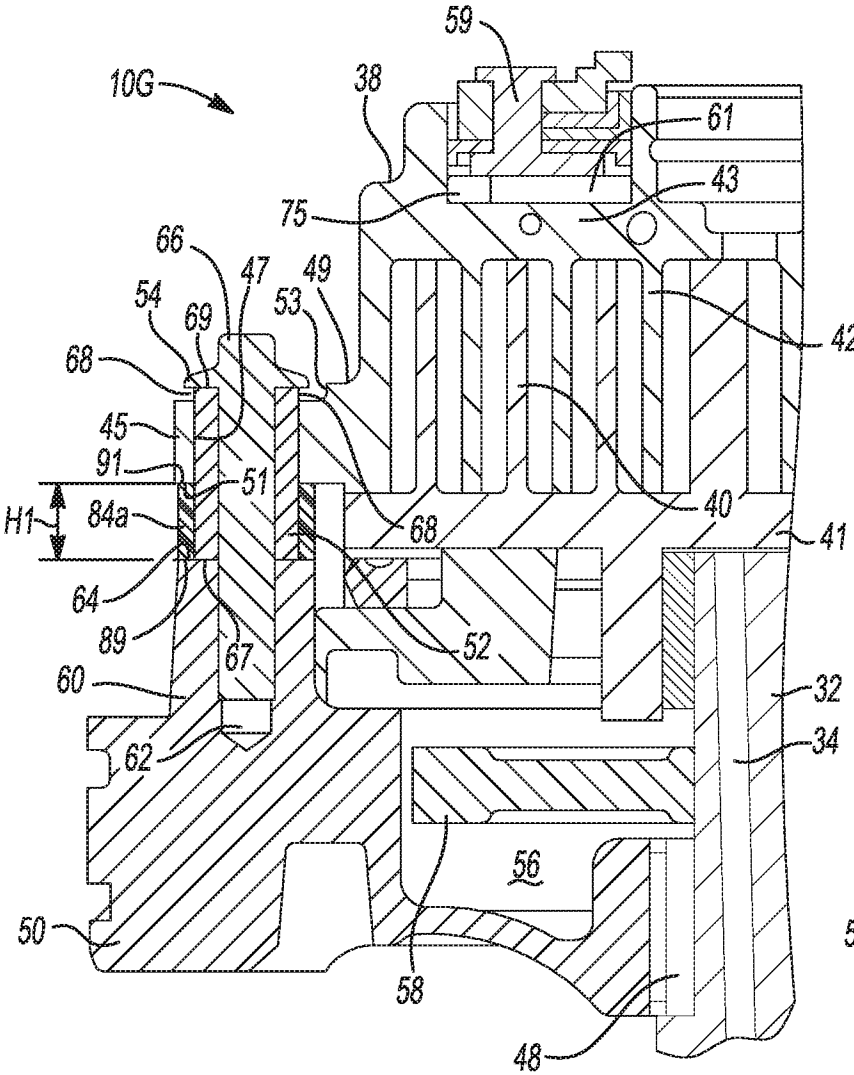
FIG. 9 is a partial cross-sectional view of a scroll compressor showing another alternative configuration of a sound isolation feature in accordance with certain aspects of the present disclosure.

With particular reference to FIG. 9, in yet another configuration, a sound isolating material may form a polymeric coating or sleeve 84*a* that may be placed on or around the outer surface of the sleeve guide 52, extending from a first end 89 adjacent the first end 67 of the sleeve guide 52 to a second end 91. The diameter of the polymeric sleeve 84*a* may be larger than the diameter of the apertures 47 in the non-orbiting scroll 38. In addition, the height H1 of the polymeric sleeve 84*a*, may be such that when compressor 10G is operating in a loaded state, and the orbiting and non-orbiting spiral wraps 40, 42 are contacting non-orbiting and orbiting plates 43, 41, respectively, the first end 89 contacts the main bearing housing 50 and the second end 91 contacts the non-orbiting scroll 38.

During operation of the compressor 10G, the sound isolation material characteristics of the polymeric sleeve 84*a*, including for example, its density and impedance value, reduce the amount of noise that would otherwise be created as the non-orbiting scroll 38 moves in the axial direction during loading and/or unloading of the compressor 10G, as described above.

Figure 10:
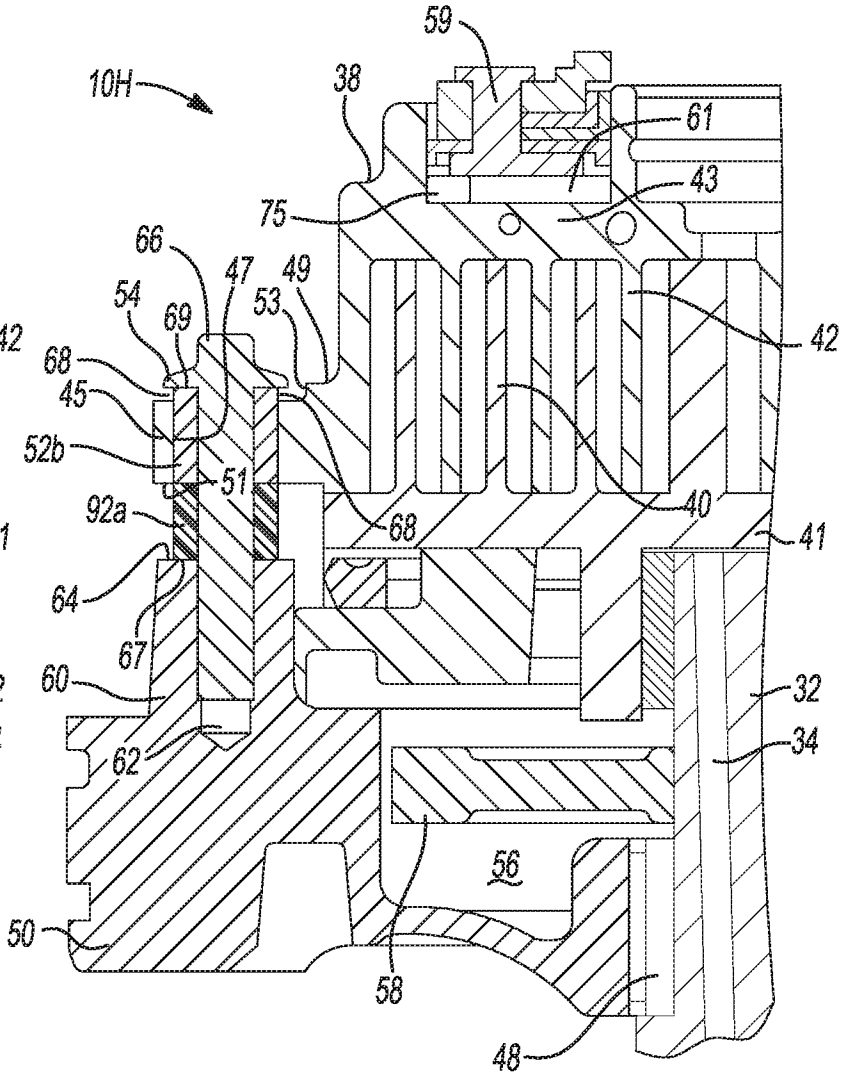
FIG. 10 is a partial cross-sectional view of a scroll compressor showing another alternative configuration of a sound isolation feature in accordance with certain aspects of the present disclosure.
Figure 11:
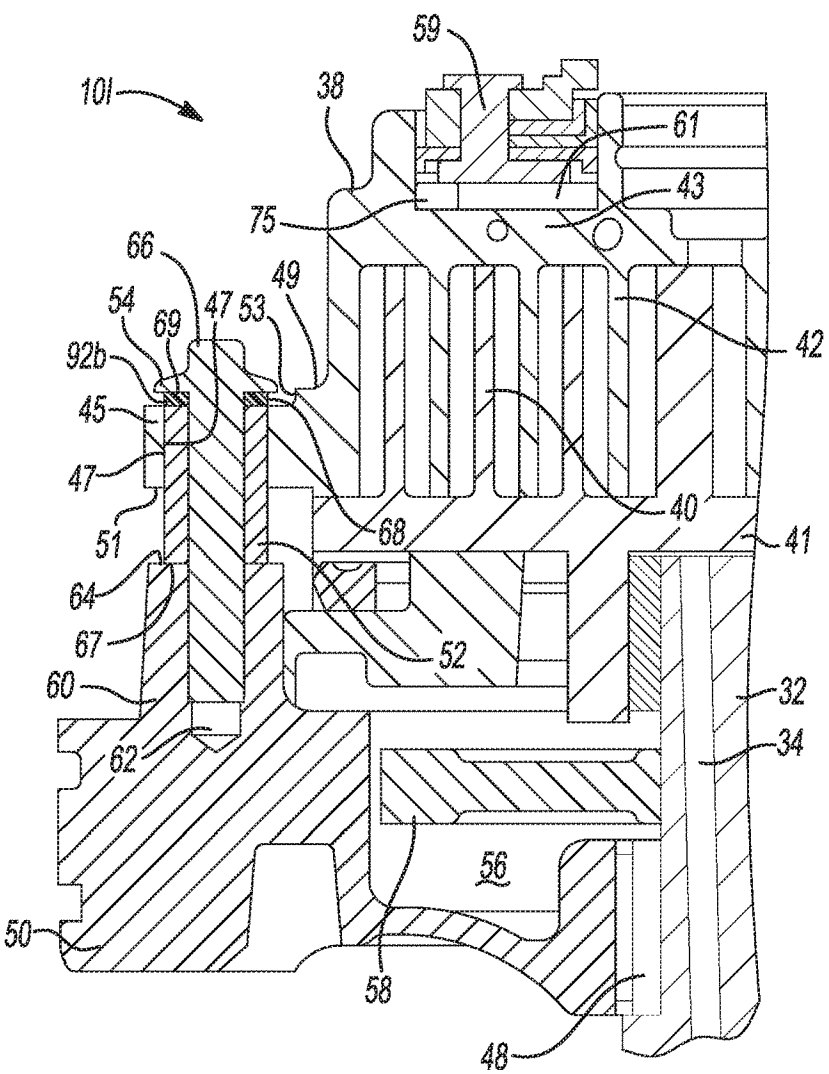
FIG. 11 is a partial cross-sectional view of a scroll compressor showing another alternative configuration of a sound isolation feature in accordance with certain aspects of the present disclosure.

With particular reference to FIGS. 10 and 11, in another configuration, a sound isolating material in accordance with yet other variations of the present disclosure may provide a polymeric tube-portion 92*a* (FIG. 10) or a gas or oil filled chamber 92*b* (FIG. 11) assembled over, and concentric to, the fasteners 54 and adjacent the first end 67 (FIG. 10) and/or the second end 69 (FIG. 11) of a modified sleeve guide 52*b* (FIG. 10) or a sleeve guide 52 (FIG. 11). In FIG. 10, the modified sleeve guide 52*b* is truncated and the tube 92*a* fills in a portion of the region that sleeve guide 52*b* would otherwise occupy and at a slightly greater diameter than an upper portion of sleeve guide 52*b*. Thus, tube 92*a* extends from lower second surface 51 of the flanged portion 45 to adjacent the first end 67 of sleeve guide 52*b*. In FIG. 11, chamber 92*b* is an annular chamber filled with gas or oil. The chamber 92*b* is supplied with oil (not shown) and includes a relief aperture (not shown) and is seated on the sleeve guide 52 between a head of fastener 54 (e.g., a bolt head), so no modification to the design of at least one radially extending flanged portion 45 is necessary. The chamber 92*b* provides a dampening of the non-orbiting scroll 38 as compressor 10I is unloaded.

During operation of the compressor 10H, the sound isolation material characteristics of the polymeric portion 92*a* of sleeve guide 52*b*, including for example its density and impedance value, reduce the amount of noise that would otherwise be created as the non-orbiting scroll 38 moves in the axial direction during loading (FIG. 10) of the compressor 10H, as described above.

During operation of the compressor 10I, the sound isolation material characteristics of the chamber 92*b*, including for example its density and impedance value, reduce the amount of noise that would otherwise be created as the non-orbiting scroll 38 moves in the axial direction during unloading (FIG. 11) of the compressor 10I, as described above.

Figure 12:
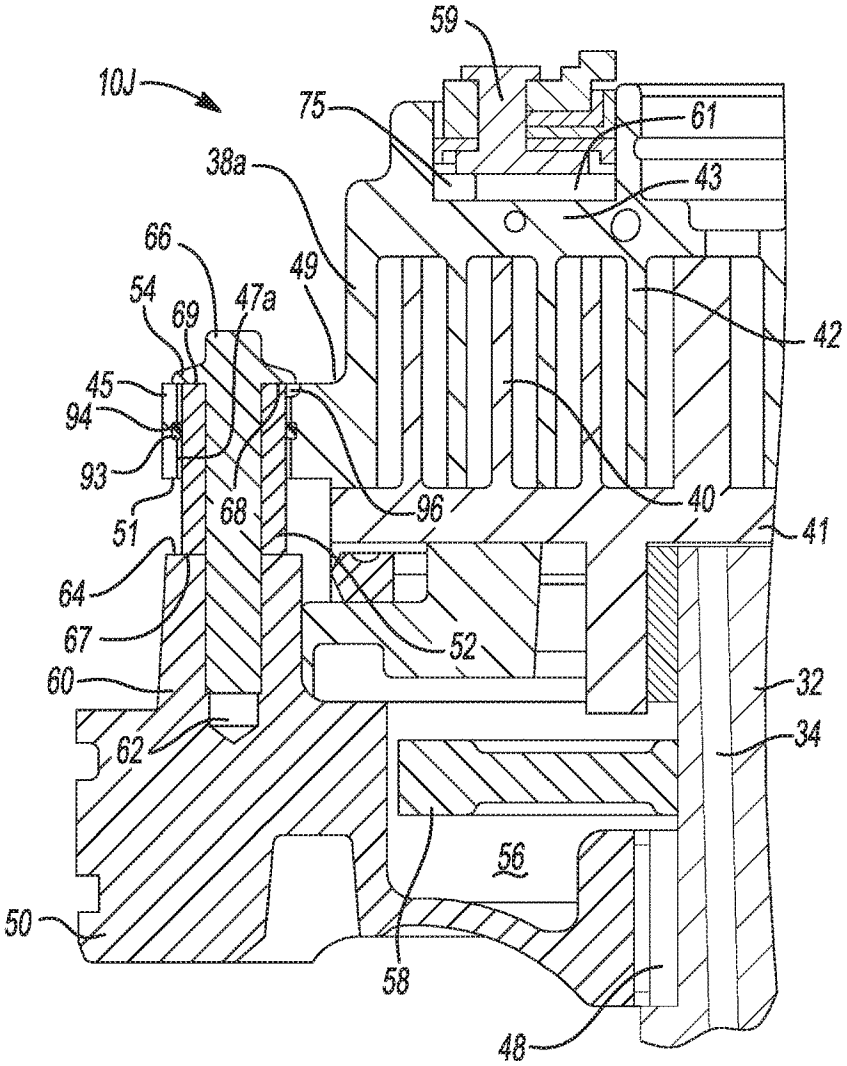
FIG. 12 is a partial cross-sectional view of a scroll compressor showing another alternative configuration of a sound isolation feature in accordance with certain aspects of the present disclosure.

With reference to FIG. 12, in another configuration, compressor 10J has an O-ring 93 disposed around sleeve guide 52. In an assembled configuration, the outer wall of the O-ring 93 may contact the apertures 47*a* of the non-orbiting scroll 38*a* and the inner wall of the O-ring 93 may contact the sleeve guide 52, to effectively seal the interface between the sleeve guide 52 and the aperture 47*a*. In this regard, an annular groove 94 may be machined or otherwise formed in the apertures 47*a* of the radially extending flanged portion 45 of non-orbiting scroll 38*a* to secure the O-ring 93 within the interface between the sleeve guide 52 and the aperture 47*a*. A recessed portion or divot 96 may be machined or otherwise formed in the first surface 49 of the flanged portion 45 of the non-orbiting scroll 38*a*, adjacent the aperture 47*a*.

During operation of the compressor 10J, lubricant from the sump 24 may be provided to the first surface 49 of the non-orbiting scroll 38*a* and may drain into or otherwise be captured by the divot 96. The lubricant may then flow from the divot 96 and into the interface between the aperture 47*a* and the sleeve guide 52, until it reaches the O-ring 93. The lubricant between the aperture 47*a* and the sleeve guide 52 will reduce the amount of noise and friction that would otherwise be generated as the non-orbiting scroll 38*a* moves in the axial direction while the compressor 10J is loading and/or unloading, as described above. In addition, the impedance value of the lubricant may differ from that of the fastener 54, the sleeve guide 52, the non-orbiting scroll 38*a* and/or the main bearing housing 50, such that sounds produced by movement of the non-orbiting scroll 38*a* are reduced or not transferred to the main bearing housing 50 or to the shell assembly 12.

Figure 13:
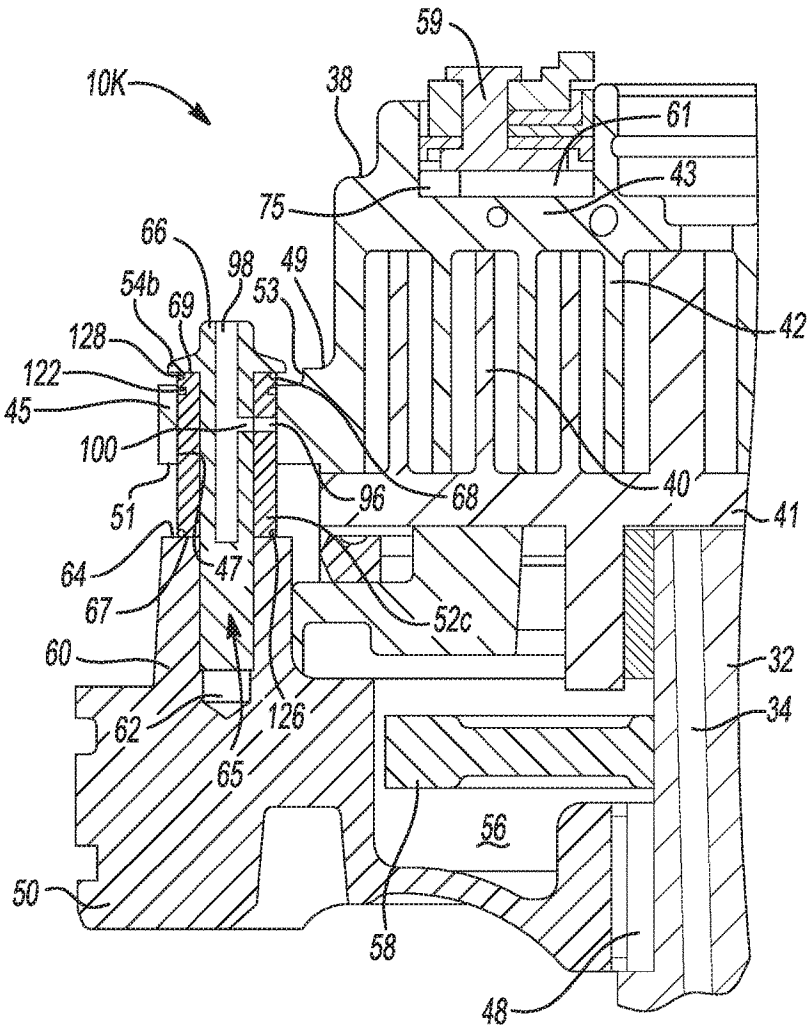
FIG. 13 is a partial cross-sectional view of a scroll compressor showing another alternative configuration of a sound isolation feature in accordance with certain aspects of the present disclosure.

With reference to FIG. 13, in another configuration, a compressor 10K may include at least one sleeve guide 52*c* and at least one fastener 54*b*. The sleeve guide 52*c* may include a radially-extending aperture, or passageway, 96 between the first and second ends 67, 69 thereof. The fastener 54*b* may include a first passageway 98 and a second passageway 100. The first passageway 98 may be a bore extending in the axial direction from the head 66 of the fastener 54*b* and into a shaft 65. The second passageway 100 may be a bore extending in the radial direction into the shaft 65 of the fastener 54*b*, such that the second passageway 100 is in fluid communication with the first passageway 98. In an assembled configuration, the aperture 96 may be substantially aligned, and in fluid communication, with the second passageway 100.

The sleeve guide 52*c* may include a groove 122 providing fluid communication between the second passageway 100 of the sleeve guide 52*c* and the interface between the sleeve guide 52*c* and the aperture 47 in the non-orbiting scroll member 38. The groove 122 may be an annular groove disposed in an outer wall of the sleeve guide 52*c* between the first and second ends 67, 69 thereof. A first and second O-ring 126, 128 may be disposed at the first and second ends 67, 69, respectively, of the sleeve guide 52*c*. The first O-ring 126 may seal the interface between the main bearing housing 50 and the first end 67 of the sleeve guide 52*c*. The second O-ring 128 may seal the interface between the second end 69 of the sleeve guide 52*c* and the head 66 of the fastener 54.

During operation of the compressor 10K, lubricant from the sump 24 may flow over the head 66 of the fastener 54*b* and drain into, or otherwise be captured by, the first passageway 98. As the lubricant fills the first passageway 98, it flows into the second passageway 100 and the aperture 96, from which it can flow into, and lubricate, the interface between the sleeve guide 52*c* and the aperture 47 in the non-orbiting scroll 38. The lubricant between the aperture 47 and the sleeve guide 52*c* will reduce the amount of noise and friction that would otherwise be created between the non-orbiting scroll 38 and the sleeve guide 52*c*, as the non-orbiting scroll 38 moves in the axial direction while the compressor 10K is loading and/or unloading, as described above. In addition, the acoustic impedance value of the lubricant may be such that sounds produced by movement of the non-orbiting scroll 38 are reduced or not transferred to the main bearing housing 50 or to the shell assembly 12.

Figure 14:
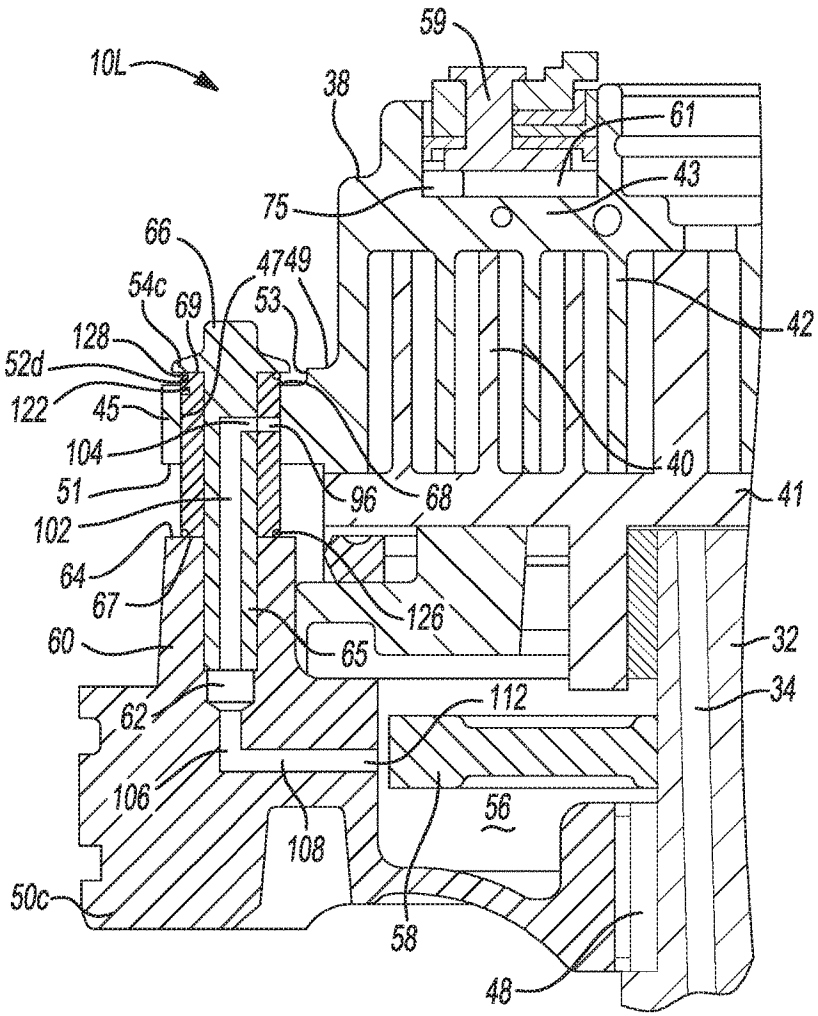
FIG. 14 is a partial cross-sectional view of a scroll compressor showing another alternative configuration of a sound isolation feature in accordance with certain aspects of the present disclosure.

With reference to FIG. 14, in another configuration, a compressor 10L may include a main bearing housing 50*c*, at least one sleeve guide 52*d* and at least one fastener 54*c*. The sleeve guide 52*d* may be identical to the sleeve guide 52*c* in FIG. 13. The fastener 54*c* may include a first passageway 102 and a second passageway 104. The first passageway 102 may be a bore extending in the axial direction through the shaft 65 of the fastener 54*c*. The first passageway 102 may be in fluid communication with the bore 62 of the main bearing housing 50*c*. The second passageway 104 may be a bore extending in the radial direction into the shaft 65 of the fastener 54*c*, such that the second passageway 104 is in fluid communication with the first passageway 102. In an assembled configuration, the aperture 96 in the sleeve guide 52*d* may be substantially aligned, and in fluid communication, with the second passageway 104.

The main bearing housing 50*c* may include a first passageway 106 and a second passageway 108. The first passageway 106 may be a bore extending in the axial direction and may be in fluid communication with the bore 62 of the main bearing housing 50*c*. The second passageway 108 may be a bore extending in the radial direction and may be in fluid communication with the first passageway 106. A first end 112 of the second passageway 108 may be in fluid communication with the counterweight cavity 56.

During operation of the compressor 10L, lubricant from the sump 24 may be pumped through the drive shaft 30 and into the counterweight cavity 56. Lubricant in the counterweight cavity 56 may flow into the bore 62 of the main bearing housing 50*c* from the second passageway 108 and the first passageway 106. From the bore 62, the lubricant may flow into the first and second passageways 102, 104 of the fastener 54*c* and into the aperture 96 in the sleeve guide 52*d*. From the aperture 96, the lubricant may flow into, and lubricate, the interface between the sleeve guide 52*d* and the aperture 47 in the non-orbiting scroll 38. The lubricant between the aperture 47 and the sleeve guide 52*d* serves to reduce the amount of noise and friction that would otherwise be created between the non-orbiting scroll 38 and the sleeve guide 52*d*, as the non-orbiting scroll 38 moves in the axial direction while the compressor 10L is loading and/or unloading, as described above. In addition, an acoustic impedance value of the lubricant may differ from that of the fastener 54*c*, the sleeve guide 52*d*, the non-orbiting scroll 38 and/or the main bearing housing 50*c*, such that sounds produced by movement of the non-orbiting scroll 38 are minimized or not transferred to the main bearing housing 50*c* or to the shell assembly 12.

Figure 16:
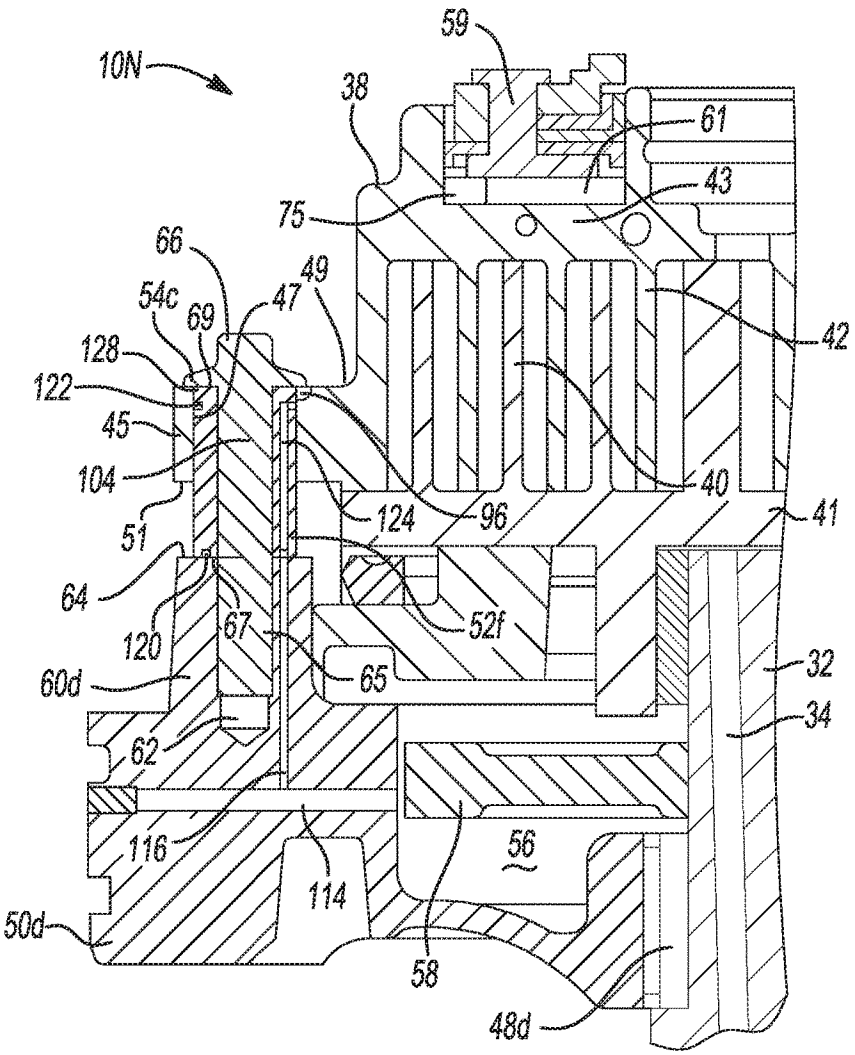
FIG. 16 is a partial cross-sectional view of a scroll compressor showing another alternative configuration of a sound isolation feature in accordance with certain aspects of the present disclosure.
Figure 15:
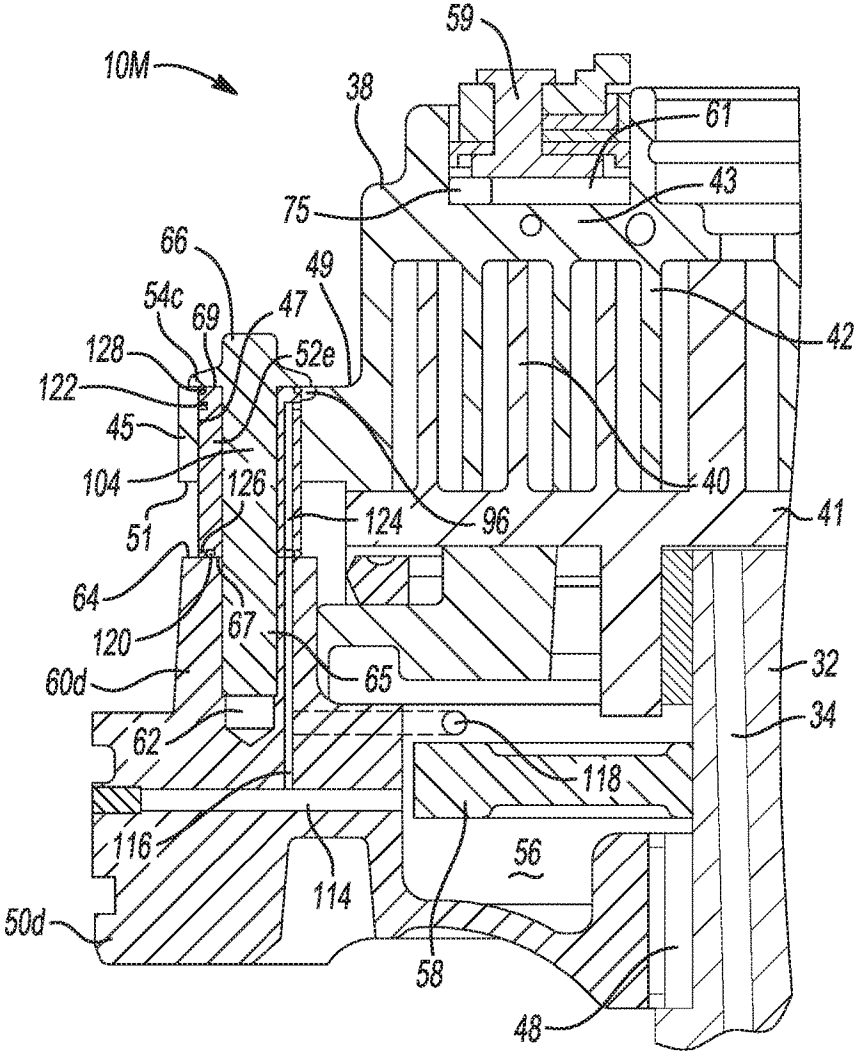
FIG. 15 is a partial cross-sectional view of a scroll compressor showing another alternative configuration of a sound isolation feature in accordance with certain aspects of the present disclosure.

With reference to FIGS. 15 and 16, in yet other configurations, a compressor 10M (FIG. 15) or compressor 10N (FIG. 16) may include main bearing housing 50*d* and at least one sleeve guide 52*e* (FIG. 15) or at least one sleeve guide 52*f* (FIG. 16). Each of the radially extending arms 60*d* of the main bearing housing 50*d* in both FIGS. 15 and 16 may include a radially extending passageway 114 and a first axially extending passageway 116. The radially extending passageway 114 may be in fluid communication with both the counterweight cavity 56 and the first axially extending passageway 116. In FIG. 15, a lubricant drain hole 118 may be disposed in an upper portion of the counterweight cavity 56, higher than the radially extending passageway 114, to enable excess lubricant in the counterweight cavity 56 to drain out of the counterweight cavity 56 and flow across the motor assembly 14 and back to the lubricant sump 24.

Each of the sleeve guides 52*e*, 52*f* may commonly include first and second grooves 120, 122 and a second axially extending passageway 124. The first groove 120 may provide fluid communication between the first axially extending passageway 116 of the main bearing housing 50*d* and the second axially extending passageway 124 of the sleeve guides (52*e* or 52*f*), regardless of any rotational misalignment between the first and second axially extending passageways 116, 124. In one configuration (FIG. 15), the first groove 120 may be an annular groove disposed in an outer wall of the sleeve guide 52*e* between the first and second ends 67, 69 thereof. In another configuration (FIG. 16), the first groove 120 may be an annular groove disposed in the first end 67 of the sleeve guide 52*f*. The second groove 122 may be in fluid communication with the second axially extending passageway 124 and the interface between the sleeve guide 52*e* and the aperture 47 in the non-orbiting scroll member 38.

In FIG. 15, the first and second O-rings 126, 128 may be disposed at the first and second ends 67, 69, respectively, of the sleeve guide 52*e*. The first O-ring 126 may seal the first groove 120 and the interface between the main bearing housing 50*d* and the first end 67 of the sleeve guide 52*e*. The second O-ring 128 may seal the interface between the second end 69 of the sleeve guide 52*e* and the head 66 of the fastener 54.

During operation of the compressor (either 10M or 10N), lubricant may be pumped via centrifugal force through the lubricant passageway 34 in the drive shaft 30 from the lubricant sump 24 to the counterweight cavity 56. In this manner, a supply of lubricant from the lubricant passageway 34 may collect in the counterweight cavity 56. Rotation of the counterweight within the counterweight cavity 56 may pump the lubricant therein through the radially extending passageway 114 in each of the radially extending arms 60*d* of the main bearing housing 50*d*, through the first axially extending passageway 116 and into the first groove 120 of the corresponding sleeve guide 52*e*. From the first groove 120, lubricant may flow through the second axially extending passageway 124 in the sleeve guide 52*e* to the second groove 122. From the second groove 122, the lubricant may flow into the interface between the sleeve guide 52*e* and the corresponding aperture 47 in the non-orbiting scroll member 38. The lubricant in the interface between the sleeve guide 52*e* and the aperture 47 dampens any movement of the non-orbiting scroll member 38 to reduce vibration and reduce or eliminate undesirable noises.

While lubricant is described above as being supplied to the sleeve guides 52*e* from the counterweight cavity 56, it is also understood that lubricant may be supplied to the sleeve guides 52*e*, 52*f* in other ways. For example, the lubricant may be pumped to the sleeve guides 52*e*, 52*f* from a bearing 48*d* housed in the main bearing housing 50*d* rather than from the counterweight cavity 56.

EXAMPLE 1

In this example, COPELAND SCROLL™ digital compressors (a ZF 32 model) having modulated capacity operation are tested. In one example, the COPELAND SCROLL™ digital compressor includes a sound isolation member according to certain variations of the present disclosure. The sound isolation member is an annulus shaped washer disposed on top of a non-orbiting scroll flange disposed around a fastener bolt. Thus, the sound isolation member is disposed between a portion of the fastener and a portion of an aperture of a radially extended flange of the non-orbiting scroll. See for example, the configuration shown in FIG. 2A. The sound isolation member comprises a sound isolation material comprising a polyester (vinyl ester) polymer and glass composite commercially available as QC8800™ from Quantum Composites, Bay City, Mich. A comparative example is a conventional COPELAND SCROLL™ digital compressor that has no sound isolation member.

Comparative sound pressure tests are conducted when each compressor is modulating. The condition of the tests is for a low temperature rating condition (−25° F./105° F./65F RG) set by the American Refrigeration Institute (ARI). The refrigerant is HFC-404A or R404A, which is a nearly azeotropic mixture of 1,1,1-trifluoroethane (HFC-143A or R143A), pentafluoroethane (HFC-125 or R125) and 1,1,1,2-tetrafluoroethane (HFC-134A or R134A). The solenoid valve (that controls modulation) is set to have 20 seconds on and 20 seconds off.

The sound pressure test results are recorded for the transient unloading events (dictated by the solenoid valve). A sound pressure range before and after the unloading event is measured. "Overshoot" is a difference in sound pressure between the highest sound pressure at transient and a steady state unloading sound (non-transient portion). Thus, transient sound pressures are measured while the compressor is axially unloading as part of the modulation. The sound pressure ranges for a transient event from loading to unloading are shown in the Table 1 below.

TABLE 1

| Line Frequency | Comparative Example Sound Pressure Range (no sound isolation member) | Inventive Example Sound Pressure Range (with sound isolation member) | Improvement |
|---|---|---|---|
| 50 Hz | 20.9 dBA | 13.6 dBA | 7.3 dBA |
| 60 Hz | 18.3 dBA | 10.8 dBA | 7.5 dBA |

Sound pressures of the compressor in Comparative Example (without the composite isolator) are measured with line frequency 50 Hz. Four unloading events are measured and the average of the four sound pressure ranges is 20.9 dBA. These impulsive sounds are uncomfortable to human ears and this is a sound quality issue. Also, the overshoots are high.

The Inventive Example is the same compressor, but has the sound isolation members formed of a composite material installed. An average sound pressure range drops to 13.58 dBA, so the reduction of the sound pressure range by the presence of the inventive sound isolation member is 20.9-13.58=7.32 dBA. Furthermore, the overshoot is nearly eliminated by the presence of the composite sound isolators.

Similar measurements are taken at a 60 Hz line frequency. A reduction of about 7.5 dBA occurs by the presence of the sound isolation member. Moreover, at the 60 Hz line frequency, overshoot is also substantially eliminated. The transient sound reduction at unloading by the presence of the sound isolation members is significant.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A scroll compressor comprising:

a bearing housing including at least one radially extending arm having an axially extending fastener bore;

an orbiting scroll member including an orbiting end plate and an orbiting spiral wrap extending from the orbiting end plate, the orbiting scroll operable to orbit about a first axis;

a non-orbiting scroll member including a non-orbiting end plate, a non-orbiting spiral wrap extending from the non-orbiting end plate and meshingly engaged with the orbiting spiral wrap, and a radially extending flanged portion, the radially extending flanged portion having a first surface and a second surface, and including at least one aperture extending axially between the first surface and the second surface, the at least one aperture substantially aligned with the axially extending fastener bore; and at least one fastener disposed within the at least one aperture and the axially extending fastener bore, the at least one fastener having a first passage extending in a direction substantially parallel to the first axis, and a second passage extending in a direction substantially perpendicular to the first axis, wherein the second passage is operable to fluidly communicate with the first passage.

2. The scroll compressor of claim 1, wherein the at least one fastener and the at least one aperture define an interface between the non-orbiting scroll member and the fastener, and wherein the second passage is operable to fluidly communicate with the interface.

3. The scroll compressor of claim 1, further comprising at least one sleeve guide disposed within the at least one aperture, wherein the fastener is further disposed within the at least one sleeve guide, and wherein the at least one sleeve guide includes a third passage operable to fluidly communicate with the second passage.

4. The scroll compressor of claim 3, wherein the at least one sleeve guide and the at least one aperture define an interface between the non-orbiting scroll member and the at least one sleeve guide, and wherein the third passage is operable to fluidly communicate with the interface.

5. The scroll compressor of claim 3, wherein the third passage extends in a direction substantially parallel to the second passage.

6. The scroll compressor of claim 3, wherein the fastener extends from a first axial end to a second axial end, and the first passage is a bore disposed at the first axial end.

7. The scroll compressor of claim 3, wherein the fastener extends from a first axial end to a second axial end, and the first passage is a bore disposed at the second axial end and operable to fluidly communicate with the axially extending fastener bore.

8. The scroll compressor of claim 7, wherein the bearing housing includes a fourth passage and a counterweight cavity, the fourth passage having a first end operable to fluidly communicate with the axially extending fastener bore and a second end operable to fluidly communicate with the counterweight cavity.

9. A scroll compressor comprising:

a bearing housing including a first passage, a second passage, a counterweight cavity, and at least one radially extending arm having an axially extending fastener bore;

an orbiting scroll member including an orbiting end plate and an orbiting spiral wrap extending from the orbiting end plate;

a non-orbiting scroll member including a non-orbiting end plate, a non-orbiting spiral wrap extending from the non-orbiting end plate and meshingly engaged with the orbiting spiral wrap, and a radially extending flanged portion, the radially extending flanged portion having a first surface and a second surface, and including at least one aperture extending axially between the first surface and the second surface, the at least one aperture substantially aligned with the axially extending fastener bore;

at least one sleeve guide disposed within the at least one aperture, the at least one sleeve guide including a third passage; and at least one fastener having a first portion disposed within the at least one sleeve guide and a second portion disposed within the axially extending fastener bore, wherein the first passage is operable to fluidly communicate with the counterweight cavity and the second passage, the second passage is operable to fluidly communicate with the third passage, and the third passage is operable to fluidly communicate with an interface between the at least one sleeve guide and the at least one aperture.

10. The scroll compressor of claim 9, wherein the at least one sleeve guide further includes a first annular groove and a second annular groove, and the third passage extends between, and is operable to fluidly communicate with, the first annular groove and the second annular groove.

11. The scroll compressor of claim 10, wherein the first annular groove and the second annular groove are each disposed in an axially extending wall of the at least one sleeve guide.

12. The scroll compressor of claim 10, wherein the first annular groove is disposed in an axially extending wall of the at least one sleeve guide, and the second annular groove is disposed in a radially extending wall of the at least one sleeve guide.

13. The scroll compressor of claim 10, further comprising a first O-ring and a second O-ring, the first O-ring sealing an interface between the bearing housing and the at least one sleeve guide and the second O-ring sealing an interface between the at least one sleeve guide and the at least one fastener.

14. The scroll compressor of claim 9, further comprising a lubricant drain hole disposed in an upper portion of the counterweight cavity, higher than the first passageway, to enable excess lubricant in the counterweight cavity to drain out of the counterweight cavity and flow across a motor assembly and to a lubricant sump.

15. A scroll compressor comprising:

a bearing housing including at least one radially extending arm having an axially extending bore;

an orbiting scroll member including an orbiting end plate and an orbiting spiral wrap extending from the orbiting end plate;

a non-orbiting scroll member including a non-orbiting end plate, a non-orbiting spiral wrap extending from the non-orbiting end plate and meshingly engaged with the orbiting spiral wrap, and a radially extending flanged portion comprising at least one axially extending aperture substantially aligned with the axially extending bore;

at least one fastener disposed within the at least one axially extending aperture and the axially extending bore;

a sound isolation member disposed between at least a portion of the fastener and at least a portion of the non-orbiting scroll member, wherein the sound isolation member comprises a fluid-filled chamber; and a sleeve guide disposed within the axially extending aperture between the fastener and the radially extending flanged portion, the fluid-filled chamber being disposed between at least a portion of the fastener and at least a portion of the sleeve guide.

16. The scroll compressor of claim 15, wherein the fluid-filled chamber includes at least one of an oil or a gas.

17. The scroll compressor of claim 15, wherein the fluid-filled chamber is an annular chamber.

18. The scroll compressor of claim 15, wherein the fluid-filled chamber contacts both the sleeve guide and the fastener.

* * * * *